US005916841A

United States Patent [19]

Amano et al.

[11] Patent Number: 5,916,841

[45] Date of Patent: Jun. 29, 1999

[54] REVERSIBLE THERMOSENSITIVE RECORDING MATERIAL

[75] Inventors: Tetsuya Amano, Numazu; Yoshihiko Hotta, Mishima; Kazumi Suzuki, Shimizu-machi, all of Japan

[73] Assignee: Ricoh Company, Ltd., Tokyo, Japan

[21] Appl. No.: 08/855,953

[22] Filed: May 14, 1997

[30] Foreign Application Priority Data

May 16, 1996 [JP] Japan ..... 8-146602

[51] Int. Cl.[6] ..... B41M 5/34; B41M 5/36; B41M 5/40

[52] U.S. Cl. ..... 503/200; 427/152; 503/201; 503/226

[58] Field of Search ..... 503/200, 201, 503/226, 204; 427/150–152

[56] References Cited

U.S. PATENT DOCUMENTS 5,426,086 6/1995 Hotta et al. ..... 503/208

5,614,461 3/1997 Itoh et al. ..... 503/201

*Primary Examiner*—Bruce H. Hess

*Attorney, Agent, or Firm*—Oblon, Spivak, McClelland, Maier & Neustadt, P.C.

[57] ABSTRACT

A reversible thermosensitive recording material has a support, and a metal-deposited light reflection layer and a reversible thermosensitive recording layer successively formed on the support, with the reversible thermosensitive recording layer being capable of showing such transparency or color tone that is reversibly changeable depending upon the temperature thereof, and having a thermal pressure level difference of 40% or less, and a thermal pressure level difference change ratio of 70% or less, and the metal-deposited light reflection layer having a corroded area ratio of at most 2% after allowed to stand at 40° C. and 95%RH for 96 hours.

14 Claims, 2 Drawing Sheets

1
2
3
4
5
6
7
8
9

REVERSIBLE THERMOSENSITIVE RECORDING MATERIAL

BACKGROUND OF THE INVENTION

1. Field of the Invention

The present invention relates to a reversible thermosensitive recording material, more particularly to a reversible thermosensitive recording material comprising a reversible thermosensitive recording layer of which transparency or color tone is reversibly changeable depending upon the temperature thereof, thereby recording information therein and erasing the information therefrom repeatedly as desired.

2. Discussion of Background

Recently attention has been paid to a reversible thermosensitive recording material capable of temporarily recording images therein and erasing the same therefrom when such images become unnecessary. For example, as disclosed in Japanese Laid-Open Patent Applications 54-119377 and 55-154198, there are conventionally known reversible thermosensitive recording materials in which an organic low-molecular-weight material such as a higher fatty acid is dispersed in a matrix resin such as a vinyl chloride-vinyl acetate copolymer with a low glass transition temperature (Tg) of 50 or 60° C. to less than 80° C.

Such conventional reversible thermosensitive recording materials, however, have the shortcomings that the recording layer is distorted while images are formed and erased repeatedly using a heating element such as a thermal head, so that image density and image contrast are significantly decreased while in use.

In order to solve the above-mentioned first problem and to improve the durability of the reversible thermosensitive recording material during the repeated operations of image formation and image erasure, the inventors of the present invention have already proposed a reversible thermosensitive recording material as disclosed in Japanese Laid-Open Patent Application 5-38872. This recording material comprises an epoxy resin as a matrix resin for use in the reversible thermosensitive recording layer. This method is capable of solving the above-mentioned first problem to some extent, but it is still insufficient for practical use.

There is proposed a reversible thermosensitive recording material in Japanese Laid-Open Patent Application 5-085045. According to this application, since a thermosetting resin comprising a hydroxy-modified vinyl chloride-vinyl acetate copolymer and an isocyanate compound is used as the matrix resin in the reversible thermosensitive recording layer, the heat resistance and mechanical strength of the reversible thermosensitive recording material are improved. As a result, the durability of the recording material can be improved while the image formation and erasure is repeatedly carried out using the thermal head.

Generally, when there is employed a reversible thermosensitive recording material comprising a matrix resin and an organic low-molecular-weight material dispersed in the matrix resin, the reversible thermosensitive recording layer assumes a transparent state within a specific temperature range (hereinafter referred to as a transparency temperature range), and such a transparent state is changed to a white opaque state at a temperature higher than the above-mentioned transparency temperature range. The mechanism of image formation and erasure in the recording layer is based on the above-mentioned change of the states. To reversibly switch the states between the transparent state and the white opaque state by the application of heat to the reversible thermosensitive recording material, it is especially necessary that the above-mentioned transparency temperature range be wide to some extent and be stable for an extended period of time.

However, with respect to the conventional reversible thermosensitive recording material as disclosed in Japanese Laid-Open Patent Application 5-085045, the transparency temperature range becomes narrow with time. The reason for this is that the curing degree of the thermosetting resin for use in the reversible thermosensitive recording layer changes with time. To be more specific, the curing degree of the thermosetting resin obtained at the formation of the reversible thermosensitive recording layer changes with time. As a result, there occurs the second problem that it is impossible to erase the image at the same image erasure temperature, as initially determined, with the lapse of time. Therefore, the determination of the image erasure temperature becomes complicated after repeated operations.

Furthermore, in the case where a resin, in particular, a resin comprising as the main component a vinyl chloride resin, is subjected to cross-linking for the formation of the reversible thermosensitive recording layer, the corrosion of a metal-deposited light reflection layer (hereinafter also referred to as a light reflection layer), which is interposed between the support and the reversible thermosensitive recording layer, cannot be avoided. Accordingly, the image contrast is lowered and the recording layer changes to red.

In order to eliminate the above-mentioned first and second problems, the inventors of the present invention have already proposed a reversible thermosensitive recording material, as disclosed in Japanese Laid-Open Patent Application 7-172072. The reversible thermosensitive recording layer of the above-mentioned recording material shows a thermal pressure level difference of 40% or less and a thermal pressure level difference change ratio of 70% or less. In this case, not only the heat resistance and the mechanical strength of the thermosensitive recording layer can be upgraded and the durability of the recording material can be improved when repeatedly used together with a thermal head, but also the stable transparency temperature range can be obtained for an extended long period of time. By using the above-mentioned reversible thermosensitive recording material, the previously mentioned conventional problems can be solved to a certain extent.

This kind of reversible thermosensitive recording material can be repeatedly used. It means that the recording material is operated or allowed to stand under a variety of circumstances. When the reversible thermosensitive recording material is allowed to stand for a long period of time under the circumstances of high humidity, for example, at 40° C. and 90%RH, or at 35° C. and 85%RH, the reflection densities of a white opaque image portion and a transparent background portion change with time. In particular, the reflection density of the white opaque image portion gradually increases. As a result, the image contrast is lowered, and visual recognition of the image becomes difficult. This problem is a new subject with respect to the reversible thermosensitive recording material, and the countermeasure against this problem has not yet been discovered.

Furthermore, this kind of reversible thermosensitive recording material has another new problem. Namely, an image portion and a background portion tend to change to red when the recording material is allowed to stand at high temperature, for example, at 50° C. to 70° C., for a long period of time or while the image formation and erasure is repeated many times using a thermal head. This problem has not yet been solved.

SUMMARY OF THE INVENTION

Accordingly, an object of the present invention is to provide a reversible thermosensitive recording material free from the above-mentioned conventional problems, capable of preventing the corrosion of the light reflection layer so as to perform the image formation without the decrease of image contrast even after allowed to stand for an extended period of time under the circumstances of high humidity; showing excellent durability even when the image formation and erasure is repeated using a thermal head; maintaining the transparency temperature range stably for an extended period of time so as to maintain excellent erasing properties; and preventing the color change of the recording layer during the repeated operations of image formation and image erasure.

The above-mentioned object of the present invention can be achieved by a reversible thermosensitive recording material comprising a support, a metal-deposited light reflection layer formed thereon, and a reversible thermosensitive recording layer formed on the light reflection layer, the reversible thermosensitive recording layer showing such transparency or color tone that is reversibly changeable depending upon the temperature thereof, and having a thermal pressure level difference of 40% or less and a thermal pressure level difference change ratio of 70% or less, and the metal-deposited light reflection layer having a corroded area ratio of at most 2% after allowed to stand at 40° C. and 95%RH for 96 hours.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The inventors of the present invention have studied and analyzed the mechanism of the decrease of image density and image contrast caused when image formation and erasure is repeatedly carried out in the reversible thermosensitive recording material. As a result, a phenomenon has been observed when the image formation is carried out by bringing a heating element such as a thermal head into pressure contact with the surface of the recording material. This phenomenon occurring in the recording layer will be explained with reference to FIGS. 1(*a*) to 1(*d*).

Figures 1A, 1B, 1C, 1D:
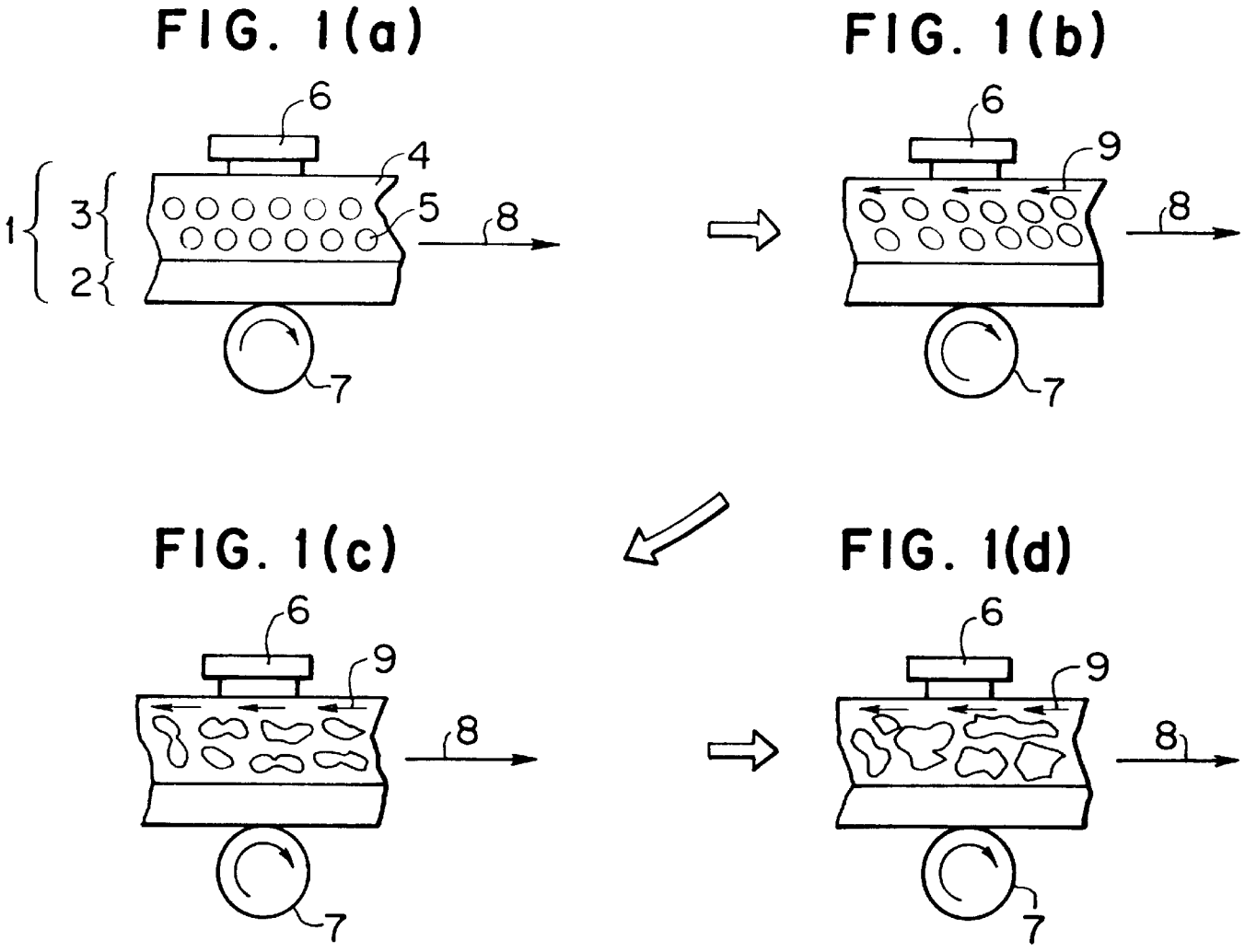
FIGS. 1(*a*) to 1(*d*) are schematic cross-sectional views of a reversible thermosensitive recording material, in explanation of the reason why the image density and the image contrast are decreased while the operation of image formation and erasure is repeated many times using a heating element.

In this case, a reversible thermosensitive recording material 1 comprises a support (PET film) 2, and a reversible thermosensitive recording layer 3 which is formed on the support 2 and comprises a matrix resin 4 and finely-divided particles of an organic low-molecular-weight material 5 dispersed in the matrix resin 4. Before the thermal energy is applied to the recording material 1 or after the thermal energy is applied thereto few times for image formation and erasure, there is no distortion in the recording layer 3 as illustrated in FIG. 1(*a*). Therefore, the condition of the components constituting the recording layer 3 is maintained, so that the particles of the organic low-molecular-weight material 5 are uniformly dispersed in the matrix resin 4.

This recording material is supposed to move in a direction of an arrow 8 with being supported by a platen roller 7. In such a conventional reversible thermosensitive recording material 1, when image formation means such as a thermal head 6 is relatively moved with respect to the reversible thermosensitive recording material 1 with coming in pressure contact with the reversible thermosensitive recording layer 3, some stress is applied to the recording layer 3 in a direction of an arrow 9 as shown in FIG. 1(*b*). While the energy is repeatedly applied to the recording layer 3 in the same direction, the distortion is caused in the energy-application direction mainly because of the above-mentioned stress, as illustrated in FIG. 1(*b*). Thus, the particles of the organic low-molecular-weight material 5 are deformed.

As repeating the application of the energy to the recording layer 3 in the same direction, the above-mentioned distortion further develops, so that the deformed particles of the organic low-molecular-weight material 5 begin to aggregate, as illustrated in FIG. 1(*c*).

Finally, the aggregated particles are further gathered to form large particles with a maximum particle size, as shown in FIG. 1(*d*). When the organic low-molecular-weight material 5 is in such a state as shown in FIG. 1(*d*), it is almost impossible to perform image formation in the recording layer 3. This is a so-called deterioration state. It is considered that the decrease of image density after repeated operations of image formation and erasure is ascribed to the above-mentioned phenomenon.

Now, the present invention will explain the reason why the transparency temperature range of the conventional reversible thermosensitive recording layer becomes narrow with time as the curing degree of the matrix resin for use in the reversible thermosensitive recording layer is changing.

The difference between the transparent state and the white opaque state of the reversible thermosensitive recording layer is considered to be based on the following principle:

(i) In the transparent state, the finely-divided particles of an organic low-molecular-weight material are dispersed in a matrix resin in such a condition that the particles tightly adhere to the matrix resin without any gap therebetween, and any void in the particles of the organic low-molecular-weight material. Therefore, the light which enters the recording layer from one side passes therethrough to the opposite side, without being scattered. Thus, the reversible thermosensitive recording layer appears transparent.

(ii) In the milky white opaque state, the organic low-molecular-weight material is composed of polycrystals consisting of numerous small crystals, so that there are gaps at the boundaries of crystals or at the interfaces between the crystals and the matrix resin. Therefore, when the light enters the recording layer, the light is scattered at the interface between the gap and the crystal, and between the gap and the resin. As a result, the reversible thermosensitive recording layer appears white opaque.

Figure 2:
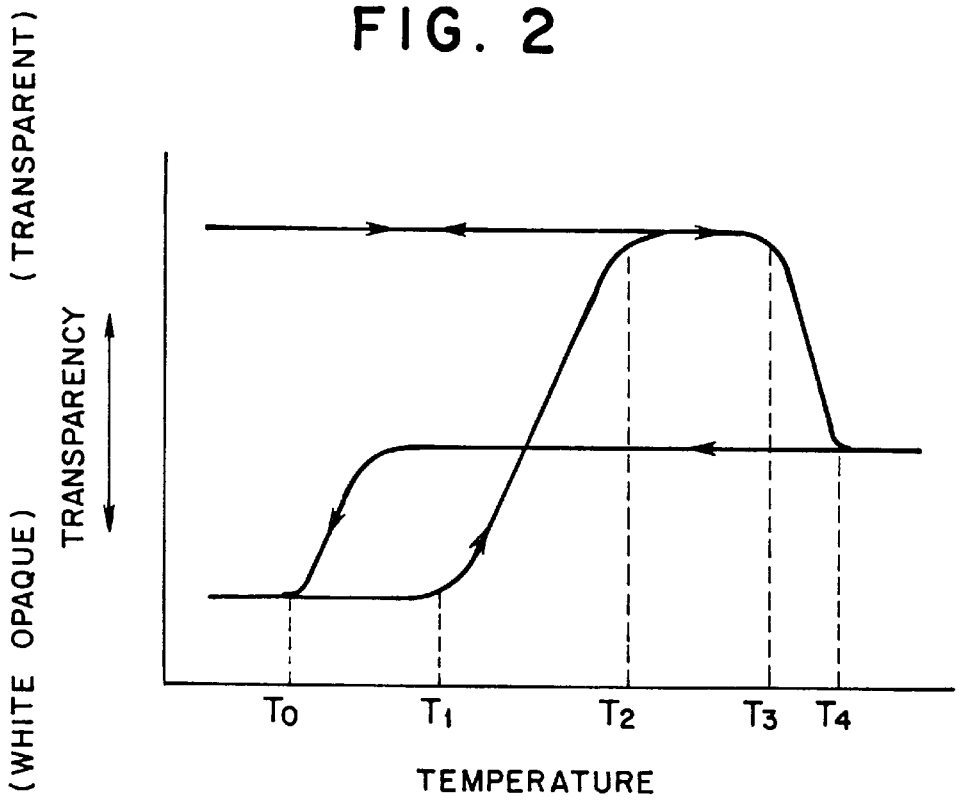
FIG. 2 is a diagram in explanation of the principle of the change in transparency of a reversible thermosensitive recording layer of the reversible thermosensitive recording material according to the present invention, depending upon the temperature thereof.

FIG. 2 is a diagram showing the change of the transparency of the reversible thermosensitive recording layer which comprises as the main components a matrix resin and the particles of an organic low-molecular-weight material dispersed in the matrix resin.

It is supposed that the recording layer is in a milky white opaque state at room temperature, that is, a temperature $T_0$ or below.

When the temperature of the recording layer is raised by the application of heat thereto, the recording layer gradually begins to become transparent from the temperature $T_1$. The recording layer assumes a completely transparant state when heated to a temperature in the range of $T_2$ to $T_3$. Even when the temperature of the recording layer in such a transparent state is decreased back to room temperature, the transparent state is maintained. This is because when the temperature of the recording layer reaches a temperature near $T_1$, the matrix resin begins to soften and is shrunk, so that the gaps at the interface between the matrix resin and the particles of the organic low-molecular-weight material, and the gaps within the particles of the low-molecular-weight material are decreased. As a result, the transparency of the recording layer gradually increases. When the temperature of the recording layer reaches $T_2$ to $T_3$, the organic low-molecular-weight material is in a half-melted state, so that the remaining gaps are filled with the organic low-molecular-weight material. As a result, the recording layer becomes transparent. The recording layer in such a transparent state, however, still contains seed crystals of the organic low-molecular-weight material. Therefore, when the recording layer in such a transparent state is cooled, the organic low-molecular-weight material crystallizes at a relatively high temperature. At the crystallization of the organic low-molecular-weight material, the matrix resin is still in a softened state, so that the matrix resin can compensate the change in volume of the organic low-molecular-weight material caused by the crystallization, thereby forming no gaps therebetween. Thus, the transparent state is maintained.

When the recording layer maintained at a temperature in the range of $T_2$ to $T_3$ is further heated to a temperature $T_4$ or more, the recording layer assumes a semi-transparent state with an intermediate transparency between the maximum transparent state and the maximum opaque state.

When the temperature of the recording layer in such a semi-transparent state is decreased, the recording layer assumes the initial milky white opaque state again, without assuming the transparent state during the cooling process.

This is because the organic low-molecular weight material is completely melted at the temperature $T_4$ or more, and thereafter, the organic low-molecular-weight material is supercooled and crystallizes out at a temperature slightly higher than the temperature $T_0$ in the course of the cooling step. It is considered that, in this case, the matrix resin cannot follow up the change in volumes of the organic low-molecular-weight material caused by the crystallization thereof, so that gaps are formed between the matrix resin and the organic low-molecular-weight material.

The temperature-transparency changes curve shown in FIG. 2 is a representative example. Depending on the materials to be employed in the recording layer, there may be some difference, for example, in the transparency at each state of the recording layer.

Thus, the change of behavior of the reversible thermosensitive recording layer at the softening point of the matrix resin or temperatures higher than that is an important factor for determining the change in transparency of the reversible thermosensitive recording layer. However, as previously mentioned, with the increase of the curing degree of the matrix resin for use in the conventional reversible thermosensitive recording layer, the softening point of the matrix resin is changed, so that the transparency temperature range becomes narrower with time.

Further, the inventors of the present invention have studied the reason why the image contrast is decreased, and the visual recognizability of the image formed in the reversible thermosensitive recording material is lowered when the recording material is allowed to stand for a long period of time under the circumstances of high humidity. As a result, it has been confirmed that such decrease of image contrast is noticeable when the metal-deposited light reflection layer is interposed between the support and the reversible thermosensitive recording layer. In this case, holes with a diameter of 10 to 100 $\mu$m on the metal-deposited light reflection layer were observed using an optical microscope. Those holes were considered to be corroded portions of the metal-deposited light reflection layer. The light reflection effect for increasing the contrast is impaired by those holes. Further, when a magnetic recording layer is provided under the light reflection layer, a black color of the magnetic layer appears at the holes of the light reflection layer, thereby still decreasing the image contrast.

The cause of the corrosion of the metal-deposited light reflection layer is considered to be as follows: The metal-deposited light reflection layer is subject to corrosion particularly when the matrix resin for use in the recording layer comprises a vinyl chloride resin. The vinyl chloride resin for use in the recording layer is decomposed by the application thereto of physical energy such as heat, light, radiation energy or shear force, thereby emitting hydrochloric acid. As a result, the light reflection layer is easily corroded in the presence of hydrochloric acid. Further, in the case where the vinyl chloride resin for use in the recording layer is cross-linked by electron beam irradiation, it is conventionally known that a chlorine atom is eliminated from the vinyl chloride portion by the electron beam irradiation, and a three-dimensional cross-linking structure is formed among the carbon atoms. In this case, as the gel percentage (i.e. the degree of cross-linking) increases, the amount of chlorine to be eliminated is increased. In proportion to the amount of chlorine, the amount of hydrochloric acid is increased, so that the light reflection layer is easily corroded.

Furthermore, the inventors of the present invention have investigated the reason why the color of reversible thermosensitive recording material changes to red when the recording material is allowed to stand under the circumstances of high temperature for a long period of time or subjected to repeated operation of image formation and erasure. As previously mentioned, it is known that the vinyl chloride resin used in the reversible thermosensitive recording layer is decomposed by the application thereto of physical energy such as heat, light, radiation energy or shear force, thereby emitting hydrochloric acid. The decomposition starts from an active point of a molecule of the vinyl chloride, that is, a branching point or a double bond point in the structure of a molecule. With the hydrochloric acid being emitted and eliminated from the above-mentioned active point of the molecule of the vinyl chloride resin, such a branching reaction or double bond reaction proceeds and the conjugated double bonds are increased, thereby forming a polyene structure. As a result, the color of the vinyl chloride resin for use in the reversible thermosensitive recording layer changes to red.

As mentioned above, it is considered that the color of the vinyl chloride resin changes to red by the action of the physical energy. The energy stress applied to the matrix resin by cross-linking operation under the application of electron beam or ultraviolet rays is larger than the thermal energy applied to a coating liquid containing the matrix resin at the drying process in the formation of the reversible thermosensitive recording layer. Even when the matrix resin is cross-linked by heat application, the thermal energy stress by the crosslinking operation is more serious than that caused by the drying operation.

As a result of the above-mentioned investigation, the conventional problems can be solved by a reversible thermosensitive recording material comprising a support, a metal-deposited light reflection layer formed thereon, and a reversible thermosensitive recording layer formed on the light reflection layer, the reversible thermosensitive recording layer showing such transparency or color tone that is reversibly changeable depending upon the temperature thereof, and having a thermal pressure level difference of 40% or less and a thermal pressure level difference change ratio of 70% or less, and the metal-deposited light reflection layer having a corroded area ratio of at most 2% after allowed to stand at 40° C. and 95%RH for 96 hours.

The above-mentioned thermal pressure level difference and the thermal pressure level difference change ratio of the reversible thermosensitive recording layer are defined as follows.

The thermal pressure level difference is a physical value indicating the hardness of a coated film when heated. The smaller the value, the harder the coated film. When the value of the thermal pressure level difference of the recording layer is 40% or less, there can be effectively obtained the advantages of the present invention over the conventional reversible thermosensitive recording materials. Particularly, the durability at the time of repeated image formation and erasure, for instance, by use of a thermal head, can be effectively upgraded. It is considered that this is because when the value of the thermal pressure level difference is 40% or less, the force for restraining the particles of an organic low-molecular-weight material from aggregating and becoming large, which may be otherwise caused by the mutual contact of the particles, is significantly increased, so that the deformation of the recording layer can be minimized even though heat and pressure are applied thereto, for instance, by a thermal head.

The thermal pressure level difference is measured by the method as described in Japanese Laid-Open Patent Application 7-172072. A desk-top hot-stamp air-type TC film erasure test machine made by Unique Machinery Company, Ltd. is used as a thermal pressure application apparatus for the measurement.

The heat- and pressure-application conditions for the measurement of the thermal pressure level difference are as follows: The applied pressure is controlled by adjusting the air regulator so that the air gauge pressure value may be 2.5 $kg/cm^2$. The printing timer is then adjusted in such a manner that the printing time is set at 10 seconds. Furthermore, the temperature regulator is adjusted in such a manner that the printing temperature is set at 130° C.

The printing temperature mentioned here is the temperature adjusted by a heater and a temperature sensor, and is approximately the same as the temperature of the surface of the printing head.

A method of measuring the value of the thermal pressure level difference of a test sample to which heat and pressure are applied by the above-mentioned thermal pressure application apparatus will now be explained.

As the measurement apparatus, a two-dimensional roughness analyzer "Surfcoder AY-41", a recorder "RA-60E", and "Surfcoder SE30K" are employed. Those are trademarks of Kosaka Laboratory Co., Ltd.

The measurement conditions for "Surfcoder SE30K" are set, for example, in such a manner that the vertical magnification (V) is 2,000, and the horizontal magnification (H) is 20.

The measurement conditions for "Surfcoder AY-41" are set, for example, in such a manner that the standard length (L) is 5 mm, and the stylus scanning speed (Ds) is 0.1 mm/sec. The measured results are recorded in charts by use of the recorder "RA-60E". The value of the thermal pressure level difference ($D_x$) in the thermal-pressure-applied portion is read from the charts in which the measured results are recorded.

The above-mentioned measurement conditions are exemplary and can be changed as desired when necessary.

The value of the thermal pressure level difference ($D_x$) is measured at 5 points, $D_1$ to $D_5$, with intervals of 2 mm therebetween in the width direction of the thermal-pressure-applied portion. The thus obtained average value is regarded as the average thermal pressure level difference ($D_m$).

The thermal pressure level difference (D) can be obtained from the average thermal pressure level difference ($D_m$) and the thickness ($D_B$) of the reversible thermosensitive recording layer in accordance with the following formula:

$$D(\%) = \frac{D_m}{D_B} \times 100$$

wherein D is the thermal pressure level difference (%); $D_m$ is the average thermal pressure level difference and $D_B$ is the thickness ($\mu$m) of the reversible thermosensitive recording layer.

The above-mentioned thickness of the reversible thermosensitive recording layer ($D_B$) can be measured by inspecting the cross section of the reversible thermosensitive recording layer by a transmission electron microscope (TEM) or a scanning electron microscope (SEM).

Since the thermal pressure level difference of the reversible thermosensitive recording layer is 40% or less in the present invention, the heat resistance and mechanical strength of the recording layer are significantly improved. Accordingly, the durability of the recording material is improved even after the image formation and erasure is carried out many times. Because of a low value of the thermal pressure level difference, the particles of the organic low-molecular-weight material are scarcely aggregated to form large particles in the recording layer. Therefore, it is supposed that the deterioration of the reversible thermosensitive recording layer can be minimized and high image contrast can be maintained even after the repeated operation of image formation and erasure.

With the above-mentioned effects being taken into consideration, it is preferable that the thermal pressure level difference of the recording layer be 30% or less, more preferably 25% or less, and further preferably 20% or less.

A thermal pressure level difference change ratio of a coated layer is a physical value indicating the degree of the change with time in the hardness of the coated layer when the coated layer is heated. The smaller the value of the thermal pressure level difference change ratio, the stabler the coated layer.

Since the thermal pressure level difference change ratio of the recording layer is 70% or less in the present invention, the stability with respect to the transparency temperature range of the recording layer is significantly improved. The thermal properties of the recording layer of the reversible thermosensitive recording material of the present invention are particularly improved in the above-mentioned critical range of the thermal pressure level difference change ratio of the recording layer.

The thermal pressure level difference change ratio can be determined in accordance with the following formula:

$$D_c(\%) = \left| \frac{D_I - D_D}{D_I} \right| \times 100$$

wherein $D_C$ is the thermal pressure level difference change ratio (%), $D_I$ is the initial thermal pressure level difference (%), and $D_D$ is the thermal pressure level difference changed with time (%).

In the above, the initial thermal pressure level difference ($D_I$) is the value of the thermal pressure level difference of a sample image portion formed on a reversible thermosensitive recording layer, measured for the first time after the preparation of the reversible thermosensitive recording layer. This is not necessarily the value measured immediately after the preparation of the recording layer.

The thermal pressure level difference changed with time ($D_D$) is the value of the thermal pressure level difference of a sample image portion which is formed on the reversible thermosensitive recording layer after the recording layer is formed at the same time as mentioned above for the measurement of the initial thermal pressure level difference ($D_I$) and then allowed to stand at 50° C. for 24 hours.

These values of the thermal pressure level difference are measured by the previously mentioned method and then calculated in the same manner as mentioned previously.

In the case where these thermal pressure level differences cannot be measured under the same conditions (2.5 kg/cm$^2$, 130° C.) as mentioned previously, the pressure and temperature may be changed appropriately.

The measurement method for the thermal pressure level difference can be applied not only to the previously mentioned reversible thermosensitive recording layer, but also to the reversible thermosensitive recording layer comprising a protective layer.

As previously mentioned, since the thermal pressure level difference change ratio of the image portion formed on the reversible thermosensitive recording layer is 70% or less in the present invention, the width of the transparency temperature range can be effectively restrained from becoming narrow. A small value of the thermal pressure level difference change ratio indicates the stable physical properties of the recording layer. Therefore, in the present invention, the transparency temperature range can be prevented from varying or the width of the transparency temperature range can be prevented from becoming narrow, and therefore, the erasing characteristics can be stably maintained for a long period of time.

In light of the effect obtained from the decrease of the thermal pressure level difference change ratio, it is preferable that the thermal pressure level difference change ratio be 50% or less, more preferably 45% or less, and further preferably 40% or less.

In the case where the reversible thermosensitive recording material of the present invention comprises a metal-deposited light reflection layer which is provided between the support and the reversible thermosensitive recording layer, the degree of corrosion of the light reflection layer has a serious effect on the contrast of the images obtained in the recording layer.

According to the present invention, the ratio of an area of the corroded portion in the light reflection layer, which will be hereinafter referred to as a corroded area ratio $S_P$ of the light reflection layer, is at most 2%, preferably 1.5% or less, and more preferably 1.3% or less.

The above-mentioned corroded area ratio ($S_P$) of the light reflection layer, which is measured after the reversible thermosensitive recording material is allowed to stand at 40° C. and 95%RH for 96 hours, indicates the degree of corrosion of the light reflection layer. The smaller the value of the corroded area ratio, the less the degree of corrosion and the higher the obtained image contrast.

The corroded area ratio of the metal-deposited light reflection layer is measured using a commercially available image processing apparatus "LA525" (Trademark), made by Pierce Corporation, and a commercially available optical microscope "OPTIPHOT 2-POL" (Trademark), and a photomicrography apparatus, "MICROFLEX AFX-DX", made by Nikon Corporation. The method for measuring the corroded area ratio is as follows:

The surface of a sample recording material is observed at arbitrary five positions using the optical microscope of 50 magnifications, and the photomicrographs are taken using the photomicrography apparatus. A copy of each photomicrograph is made on a sheet of tracing paper. The image-bearing tracing paper is then set on a table of the image processing apparatus, and the image formed on the tracing paper is subjected to image processing with the transmitted light being applied to the table from the bottom thereof. Thus, an area (S) of the hole portions, that is, the corroded portions of the metal-deposited light reflection layer, is calculated. Such calculation is made with respect to all of five measuring positions to obtain the areas ($S_1$) to ($S_5$). The average value of those areas ($S_1$) to ($S_5$) is regarded as an average corroded area ($S_m$) of the metal-deposited light reflection layer.

Then, the corroded area ratio ($S_P$) of the light reflection layer is determined from the above-mentioned average corroded area ($S_m$) and the total image area ($S_B$) on the copy paper of the above-mentioned photomicrograph in accordance with the following formula:

$$S_P(\%) = (S_m/S_B) \times 100$$

wherein $S_P$ indicates the corroded area ratio (%) of the light reflection layer after storage at 40° C. and 95%RH for 96 hours; $S_m$, the average corroded area in the light reflection layer; and $S_B$, the total image area.

Furthermore, to prevent the color change of the recording layer, and to prevent the light reflection layer from being corroded when the recording material is allowed to stand under the circumstances of high humidity, the addition of a stabilizer to the recording layer is very effective. According to the present invention, the reversible thermosensitive recording layer may comprise at least one stabilizer selected from the group consisting of an epoxy compound with an epoxy equivalent of less than 600 g/eq and a bis(alkyl tin fatty acid monocarboxylic acid salt)oxide.

It is preferable that the above-mentioned stabilizer such as an epoxy compound be added in an amount of 0.01 to 30 parts by weight, more preferably in an amount of 0.1 to 20 parts by weight, further preferably in an amount of 1 to 10 parts by weight, to 100 parts by weight of a polymeric resin for use in the matrix resin of the reversible thermosensitive recording layer.

In the present invention, the epoxy equivalent of the above-mentioned epoxy compound used as the stabilizer in the recording layer is less than that employed in the conventional reversible thermosensitive recording layer. In other words, there is employed an epoxy compound of which epoxy content in one molecule thereof is relatively large. For instance, when the polymeric resin for use in the matrix resin comprises a vinyl chloride resin, such an epoxy compound can fulfill the function of trapping hydrochloric acid generated from the vinyl chloride resin. Consequently, the increase of the conjugated double bonds can be restrained, and the contact of the hydrochloric acid with the light reflection layer can be avoided.

In light of the above-mentioned effect of the epoxy compound used in the recording layer, it is preferable that the epoxy equivalent of the epoxy compound serving as the stabilizer be 400 g/eq or less, more preferably 300 g/eq or less.

The above-mentioned epoxy compound for use in the present invention is roughly classified into two groups, that is, a glycidyl ether and an epoxidized ester. A condensation product of 2,2-bis(4-hydroxyphenyl)propane and epichlorohydrin is one example of the glycidyl ether; epoxidized natural oil such as epoxidized triglyceride, one example of the epoxidized ester.

Specific examples of the epoxy compound for use in the present invention are as follows: epoxidized soybean oil, epoxyallyl phthalate, epoxidized fatty acid and metallic salts thereof, epoxidized materials of tetrahydrophthalic-acid-containing polyester, polyethylene glycol mono (epoxystearyl ether), bisepoxyalkyl phthalate, 1-benzyloxy-2,6-epoxypropane, 2,3-epoxycyclopentanol ester, and 2,3-epoxycyclopentanol ether.

The above-mentioned epoxy compounds may be used alone or in combination, and in particular, the epoxidized ester compound is preferably employed.

Further, a bis(alkyl tin fatty acid monocarboxylic acid salt)oxide may also be used as the stabilizer in the reversible thermosensitive recording layer. In this case, it is also preferable that the amount of the above-mentioned organotin compound be in the range of 0.01 to 30 parts by weight, more preferably 0.1 to 20 parts by weight, and further preferably 1 to 10 parts by weight, to 100 parts by weight of the polymeric resin for use in the matrix resin of the recording layer. Such an organotin compound which may be added to the reversible thermosensitive recording layer has an effect of preventing the color of the recording layer from changing and preventing the corrosion of the light reflection layer even when the recording material is allowed to stand under the circumstances of high humidity.

The above-mentioned bis(alkyl tin fatty acid monocarboxylic acid salt)oxide shows excellent stability under the circumstances of high humidity as compared with the conventional organotin compound for use in the conventional reversible thermosensitive recording material, and has an effect of trapping hydrochloric acid generated from the vinyl chloride resin, as previously mentioned.

The organotin compound for use in the present invention is roughly divided into two groups, that is, a bis(monoalkyl tin fatty acid monocarboxylic acid salt)oxide and a bis (dialkyl tin fatty acid monocarboxylic acid salt)oxide. For the monoalkyl group and dialkyl group, there can be employed methyl group, butyl group, and octyl group.

Specific examples of the above-mentioned organotin compound are bis(dibutyl tin laurate)oxide, bis(dioctyl tin laurate)oxide, bis(butyl tin laurate)oxide, and bis(octyl tin laurate)oxide.

Furthermore, in order to enhance the stabilizing effect, a variety of the following stabilizers may be employed in combination with the above-mentioned epoxy compound and organotin compound.

(i) Lead-containing stabilizer: basic lead carbonate, tribasic lead sulphate, dibasic lead phosphite, basic silicate white lead, dibasic lead phthalate, tribasic lead maleate, dibasic lead stearate, co-precipitated lead silicate and silica gel, and normal lead salicylate.

(ii) Organotin stabilizer: organotin laurate compounds such as dialkyltin fatty acid salts and monoalkyltin fatty acid salts; organotin mercapto compounds such as dialkyl mercaptocarboxylic acid salts, salts of monoalkyltin mercaptocarboxylate, salts of dialkyltin mercaptocarboxylate, and dialkyltin sulfide; and organotin maleate compounds such as dialkyltin maleate polymer and dialkyltin maleate salts. For the above-mentioned monoalkyl group and dialkyl group, methyl group, butyl group, and octyl group can be employed.

(iii) Other stabilizers: metal soap, stabilizers containing no lead nor tin, chelating compounds such as organic phosphite, organic polyphosphite, hindered phenols and organic sulfide, antioxidants such as phenol derivatives, amine derivatives and inorganic phosphite, and ultraviolet absorbing agents such as salicylate and derivatives thereof, and benzophenone derivatives.

It is preferable that the amount of those additional stabilizers to be contained in the reversible thermosensitive recording layer be in the range of 10 to 300 parts by weight, more preferably in the range of 30 to 200 parts by weight, further preferably in the range of 50 to 150 parts by weight, to 100 parts by weight of the previously mentioned epoxy compound or bis(alkyl tin fatty acid monocarboxylic acid salt)oxide.

Further, in the present invention, it is preferable that the polymeric resin for use in the matrix resin constituting the reversible thermosensitive recording layer be cross-linked. In this case, the durability of the obtained reversible thermosensitive recording material can be improved even when image formation and erasure is repeatedly carried out using a heating element such as a thermal head. The cross-linking may be performed by electron beam irradiation, ultraviolet light irradiation, or heat application, using a cross-linking agent.

It is preferable that the gel percentage of such a cross-linked resin be 30% or more, more preferably 50% or more, further preferably 70% or more, and still further preferably 80% or more.

When the matrix resin for use in the recording layer comprises a cross-linked resin with a gel percentage of 30% or more, the heat resistance and the mechanical strength of the obtained recording layer are remarkably improved. In addition, aggregation of the particles of the organic low-molecular-weight material can be prevented. Therefore, deterioration caused by the repeated operation of image formation and erasure can be minimized and high image contrast can be maintained for an extended period of time.

The gel percentage of the cross-linked resin for use in the reversible thermosensitive recording layer is measured by the following method:

A reversible thermosensitive recording layer with an appropriate thickness is formed on a support, and the cross-linking of the recording layer is then performed by electron beam irradiation or ultraviolet-light irradiation. The cross-linked recording layer thus obtained is then peeled off the support, and the initial weight of a sample film of the recording layer is measured.

Thereafter, the recording layer sample film is held between a pair of 400-mesh wire nets, and immersed into a solvent in which the resin component obtained at the initial step prior to the cross-linking step is soluble.

The sample film is maintained in the solvent for 24 hours, and then, dried in vacuum, and the weight of the dried sample film is measured.

The gel percentage is calculated in accordance with the following formula:

$$\text{Gel percentage}(\%) = \frac{\text{Weight of sample film after drying (g)}}{\text{Initial weight of sample film (g)}} \times 100$$

For the above-mentioned calculation, it is necessary to remove the weight of the organic low-molecular-weight material. Thus, the gel percentage is calculated in accordance with the following formula:

$$\text{Gel percentage}(\%) = \frac{\text{Weight of sample film after drying (g)}}{\text{Initial weight of sample film (g)} - \text{Weight of organic low-molecular-weight material (g)}} \times 100$$

In the above, when the weight of the organic low-molecular-weight material is unknown in the calculation of the gel percentage, a cross section of the recording layer is obtained using a transmission electron microscope (TEM) or a scanning electron microscope (SEM). From the above-mentioned cross section, the ratio of the area of the organic low-molecular-weight material to that of the resin per unit area of the cross section is determined. Next, the ratio of the weight of the organic low-molecular-weight material to that of the resin is calculated from the above obtained area ratio and the respective specific densities of the organic low-molecular-weight material and the resin. Thus, the weight of the organic low-molecular-weight material can be obtained for the calculation of the gel percentage.

Furthermore, in the case of a reversible thermosensitive recording material comprising a support, a reversible thermosensitive recording layer formed thereon, and other layers which are overlaid on the reversible thermosensitive recording layer or interposed between the support and the reversible thermosensitive recording layer, the thickness of each layer is measured by the cross-sectional observation by TEM or SEM, and the surface of the reversible thermosensitive recording layer is exposed by scraping the overlaid layers off the reversible thermosensitive recording layer. Then, the reversible thermosensitive recording layer may be peeled off to prepare a sample film.

In the above, when there is provided a protective layer comprising, for example, an ultraviolet curing resin, on the reversible thermosensitive recording layer, it is necessary to scrape such a protective layer off the reversible thermosensitive recording layer, and also to scrape the surface portion of the reversible thermosensitive recording layer slightly in order to minimize the contamination of the reversible thermosensitive recording layer with the resin component of the protective layer. Thus, the gel percentage of the reversible thermosensitive recording layer can be accurately measured by preventing adverse effects of the resin component from the protective layer.

In addition to the above, the gel percentage may be measured by the following three methods:

In the first method, a cross-linked hardened resin film is extracted with a solvent in which the uncross-linked resin component is soluble, for instance, for 4 hours, by use of a Soxhlet extractor, to remove the uncross-linked resin component from the cross-linked hardened resin film. Then, the weight percentage of the unextracted residue is obtained.

In the second method, a recording film layer is formed by coating on a surface-treated PET support. The thus formed recording film layer is then subjected to electron beam (BE) irradiation and immersed in a solvent. Thus, the ratio of the thickness of the recording film layer before the immersion to the thickness of the recording film layer after the immersion is obtained.

In the third method, a recording film layer is formed in the same manner as in the above-mentioned second method, and 0.2 ml of a solvent is dropped on the surface of the recording film layer using a dropping pipette. Then, the recording layer film is allowed to stand for 10 seconds. Thereafter, the solvent is wiped off the surface of the recording film layer, whereby the ratio of the thickness of the recording film layer before the dropping of the solvent to the thickness of the recording film layer after the dropping of the solvent is obtained.

In the above-mentioned first method, the gel percentage calculation may be performed in such a manner that the weight of the organic low-molecular-weight material is eliminated from the initial weight of the recording film layer, as mentioned previously.

In contrast to this, in the above-mentioned second and third methods, the thickness of the recording film layer is measured. If the matrix resin which surrounds the organic low-molecular-weight material is completely cross-linked, it is considered that the thickness of the recording film layer is not changed by immersing the recording layer into the solvent. Therefore, it is unnecessary to take the presence of the organic low-molecular-weight material into consideration in the second and third methods, unlike the first method.

Furthermore, in the case where other layers are overlaid on the reversible thermosensitive recording layer and/or interposed between the support and the recording layer, the first method can be carried out in the same manner as mentioned above. When the above-mentioned second and third methods are employed, only the overlaid layers may be scraped off the reversible thermosensitive recording layer.

The resin contained in the reversible thermosensitive recording layer can be cross-linked by heat application, ultraviolet light irradiation, or electron beam irradiation. In light of the purpose of cross-linking of the resin, ultraviolet light irradiation and electron beam irradiation are preferable to heat application. Of these two irradiation methods, electron beam irradiation is more preferable.

The reasons why the cross-linking by electron beam irradiation is preferable will now be explained in detail.

The significant differences between the cross-linking of resin by electron beam irradiation (hereinafter referred to as EB cross-linking) and the cross-linking of resin by ultraviolet light irradiation (hereinafter referred to as UV cross-linking) are as follows:

In the UV cross-linking, a photopolymerization initiator and a photosensitizer are necessary. The resins for UV cross-linking are mostly limited to resins having transparency. In contrast to this, in the EB cross-linking, the concentration of radicals is so high that the cross-linking reaction proceeds rapidly, so that the polymerization is terminated instantly. Furthermore, EB irradiation can provide more energy than UV irradiation can, so that the reversible thermosensitive recording layer can be made thicker.

Furthermore, as mentioned above, a photopolymerization initiator and a photosensitizer are necessary in the UV cross-linking, so that such additives will remain in the reversible thermosensitive recording layer after completion of the cross-linking reaction. There may be the risk that these additives have adverse effects on the image formation performance, image erasure performance, and repeated use durability of the reversible thermosensitive recording layer.

The significant differences between the EB cross-linking and the thermal cross-linking (cross-linking of resin by heat application) are as follows:

In the thermal cross-linking, a catalyst and a promoting agent for cross-linking are required. Even though the catalyst and promoting agent are employed, however, the reaction speed of the thermal cross-linking is considerably slower than that of the reaction by EB cross-linking. Furthermore, in the case of the thermal cross-linking, additives such as the above-mentioned catalyst and promoting agent will remain in the reversible thermosensitive recording layer after the completion of the cross-linking reaction similar to the case of UV cross-linking. Therefore thermal cross-linking has the same shortcomings as the UV cross-linking does. Furthermore, due to the remaining catalyst and promoting agent, the cross-linking reaction may slightly proceed after the initial cross-linking. As a result, the characteristics of the reversible thermosensitive recording layer may change with time.

For the above-mentioned reasons, the EB irradiation is the most suitable for the cross-linking of the resin for use in the reversible thermosensitive recording layer in the present invention. In addition to the above, by the EB irradiation, deterioration of the image density can be minimized, so that high image contrast can be maintained even though image formation is repeatedly carried out in the recording layer.

In the present invention, the reversible thermosensitive recording layer of the recording material has the characteristics that the transparency or color tone of the recording layer is reversibly changeable depending on the temperature thereof. Namely, the recording layer comprises a material capable of reversibly causing a visual change depending on the temperature of the material. In the present invention, the material capable of reversibly showing a change in color, not a change in shape is employed. Such a color change of the recording material takes place because of the changes of light transmittance, light reflectance, absorption wavelength, and the scattering properties of the recording material. By combining the above-mentioned changes of the characteristic properties, the reversible thermosensitive recording material causes the reversible color change, thereby forming an image therein and erasing the same therefrom.

Any recording materials capable of reversibly changing the transparency or color tone depending upon the temperature thereof are available. For example, there are proposed several recording materials, each of which assumes a first color development state by heating to a first predetermined temperature higher than room temperature, and further assumes a second color development state by heating the recording material at a second predetermined temperature higher than the first color development temperature, and then cooling. This kind of recording material is preferred in the present invention. To be more specific, a recording material which can assume a transparent state at a first predetermined temperature and a white opaque state at a second predetermined temperature is proposed, as disclosed in Japanese Laid-Open Patent Application 55-154198; a recording material which can produce a color at a second predetermined temperature and erase the produced color at a first predetermined temperature, as disclosed in Japanese Laid-Open Patent Applications 4-224996, 4- 247985 and 4-267190; a recording material which can assume a white opaque state at a first predetermined temperature and a transparent state at a second predetermined temperature, as disclosed in Japanese Laid-Open Patent Application 3-169590; and a recording material which can assume a black, red or blue color at a first predetermined temperature, and erase the produced color at a predetermined second temperature, as disclosed in Japanese Laid-Open Patent Applications 2-188293 and 2-188294.

As previously mentioned, the reversible thermosensitive recording materials preferred in the present invention can be divided into the following two groups:

(1) A recording material which can reversibly assume a transparent state and a white opaque state.

(2) A recording material which can cause a reversible color change by the chemical reaction of a coloring material such as a dye contained therein.

As a representative example of the recording material (1), there is proposed a recording material comprising a support and a thermosensitive recording layer formed on the support, which comprises a matrix resin such as polyester, and an organic low-molecular-weight material such as a higher alcohol or a higher fatty acid, dispersed in the matrix resin, as previously mentioned. On the other hand, a leuco-based thermosensitive recording material with improved reversibility is proposed as the representative example of the recording material (2).

The reversible thermosensitive recording material (1) will now be described in detail.

The reversible thermosensitive recording layer of the recording material of type (1) comprises as the main components the matrix resin and the organic low-molecular-weight material dispersed in the matrix resin. The recording material (1) can assume a transparent state within a temperature range characteristic to the recording material.

With the principle of the reversible change in transparency being taken into consideration, a milky white opaque image can be obtained on a transparent background, or a transparent image can also be obtained on a milky white opaque background by selectively applying the thermal energy to the reversible thermosensitive recording material (1). Further, such image formation and erasure can be repeated over a long period of time.

When a colored sheet is placed behind the reversible thermosensitive recording layer of the recording material (1), a colored image can be obtained on a white opaque background or a white opaque image can be obtained on a colored background.

In the case where the images formed in the reversible thermosensitive recording material (1) are projected on a screen using an over head projector (OHP), a milky white opaque portion in the recording material (1) appears dark, and a transparent portion in the recording material (1), through which the light passes, becomes a bright portion on the screen.

It is preferable that the thickness of the reversible thermosensitive recording layer of the recording material (1) be in the range of 1 to 30 $\mu$m, and more preferably in the range of 2 to 20 $\mu$m. When the thickness of the recording layer is within the above-mentioned range, the thermal distribution in the recording layer becomes uniform so as to uniformly make the recording layer transparent. Further, the decrease of image contrast due to the decrease of the milky whiteness degree can be prevented. The milky whiteness degree of the reversible thermosensitive recording layer can be further increased by increasing the amount of a fatty acid to be contained as the organic low-molecular-weight material in the recording layer.

In the present invention, the reversible thermosensitive recording material of type (1) can be fabricated in such a manner that a reversible thermosensitive recording layer is provided on a support by any of the following methods (i) to (iii). The reversible thermosensitive recording layer may be made into a sheet-shaped film without using the support as the case may be.

(i) A matrix resin, an organic low-molecular-weight material and a stabilizer for use in the present invention are dissolved in a solvent to obtain a coating liquid. This coating liquid may be coated on a support. As evaporating the solvent component of the coating liquid to form a layer (or sheet-shaped film), the layer (or sheet-shaped film) is cross-linked. The cross-linking may be performed after the formation of the layer (or sheet-shaped film).

(ii) A matrix resin and a stabilizer for use in the present invention are dissolved in a solvent in which they are soluble, but an organic low-molecular-weight material to be employed is not soluble. The organic low-molecular-weight material is pulverized by any of the conventional methods and dispersed in the above prepared solution, so that a coating liquid is prepared. This coating liquid may be coated on a support. As evaporating the solvent component of the coating liquid to form a layer (or sheet-shaped film), the layer (or sheet-shaped film) is cross-linked. The cross-linking may be performed after the formation of the layer (or sheet-shaped film).

(iii) A matrix resin, an organic low-molecular-weight material and a stabilizer for use in the present invention are melted with the application of heat thereto without using a solvent. The thus melted mixture is formed into a layer (or sheet-shaped film), and cooled. The thus formed layer (or sheet-shaped film) is then subjected to cross-linking.

As the solvents for the formation of a reversible thermosensitive recording layer or a reversible thermosensitive recording material, a variety of solvents can be employed depending on the kinds of matrix resin and organic low-molecular-weight material to be employed.

Specific examples of such solvents include tetrahydrofuran, methyl ethyl ketone, methyl isobutyl ketone, chloroform, carbon tetrachloride, ethanol, toluene and benzene.

The organic low-molecular-weight material is present in a dispersed state in the form of finely-divided particles in the obtained reversible thermosensitive recording layer by using not only the dispersion, but also the solution as the coating liquid for the formation of the recording layer.

In the present invention, as the polymeric resin for use in the matrix resin constituting the reversible thermosensitive recording layer, any polymeric resin that can be formed into a layer or sheet-shaped film and has excellent transparency and stable mechanical strength is preferably employed.

As the above-mentioned polymeric resin, the following resins can be employed: polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, copolymer of vinyl chloride and a vinyl ester of fatty acid having 3 or more carbon atoms, and vinyl chloride-ethylene copolymer; polyvinylidene chloride; and vinylidene chloride copolymers such as vinylidene chloride-vinyl chloride copolymer, and vinylidene chloride-acrylonitrile copolymer.

The above-mentioned resins may be employed in combination with at least one resin selected from the group consisting of saturated polyester, polyethylene, polypropylene, polystyrene, polymethacrylate, methacrylate copolymers, polyamide, polyvinyl pyrrolidone, natural rubber, polyacrolein, polycarbonate, and a copolymer comprising any of the above-mentioned resin components.

In addition, as the resin, polyacrylate, polyacrylamide, polysiloxane, polyvinyl alcohol, and copolymers comprising any of the monomers constituting these polymers can be employed.

In the case where the polymeric resin for use in the matrix resin comprises a vinyl chloride copolymer in the recording layer, it is preferable that the average polymerization degree (p) of the vinyl chloride copolymer be 300 or more, and more preferably 600 or more. It is preferable that the weight ratio of the vinyl chloride unit to a copolymerizable unit be in the range of 90/10 to 40/60, and more preferably in the range of 85/15 to 50/50.

It is preferable that the polymeric resins for use in the matrix resin in the reversible thermosensitive recording layer have a glass transition temperature (Tg) of less than 100° C., more preferably less than 90° C., and further preferably less than 80° C.

It is required that the organic low-molecular-weight material for use in the present invention be formed in the shape of particles in the reversible thermosensitive recording layer. It is preferable that the organic low-molecular-weight material have a melting point in the range of 30 to 200° C., and more preferably in the range of 50 to 150° C.

Specific examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, and saturated or unsaturated dicarboxylic acids, and esters, amides and ammonium salts thereof; saturated or unsaturated halogenated fatty acids and esters, amides and ammonium salts thereof; allylcarboxylic acids, and esters, amines and ammonium salts thereof; halogenated allylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned organic low-molecular-weight material be in the range of 10 to 60, more preferably in the range of 10 to 38, and further preferably in the range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen atom in its molecule. More specifically, it is preferable that the organic low-molecular-weight materials comprise, for instance, —OH, —COOH, —CONH, —COOR, —NH, —$NH_2$, —S—, —S—S—, —O— or a halogen atom.

In the present invention, it is preferable to use a composite material comprising an organic low-molecular-weight material having a low melting point and an organic low-molecular-weight material having a high melting point as the above-mentioned organic low-molecular-weight material. The transparency temperature range of the reversible thermosensitive recording layer can be further increased by use of such a composite material as the organic low-molecular-weight material. It is preferable that the difference in the melting point between the low-melting point organic low-molecular-weight material and the high-melting point organic low-molecular-weight material be 20° C. or more, more preferably 30° C. or more, and further preferably 40° C. or more.

It is preferable that the low-melting point organic low-molecular-weight material have a melting point in the range of 40 to 100° C., more preferably in the range of 50 to 80° C.

It is preferable that the high-melting point organic low-molecular-weight material have a melting point in the range of 100 to 200° C., more preferably in the range of 110 to 180° C.

Preferable examples of the low-melting point organic low-molecular-weight material are as follows:

(a) fatty acid esters, (b) dibasic acid esters, and (c) polyhydric alcohol alkanedioic acid esters.

Those materials (a) to (c) may be used alone or in combination.

The above-mentioned fatty acid esters (a) will now be explained in detail.

A fatty acid ester serving as the low-melting point organic low-molecular-weight material has the characteristics that the melting point thereof is lower than that of the fatty acid having the same number of carbon atoms (in an associated state of two molecules). In other words, the number of carbon atoms of the fatty acid ester is more than that of the fatty acid having the same melting point as that of the above-mentioned fatty acid ester.

As previously mentioned, it is considered that when the operation of image formation and erasure is repeated using a thermal head, the reversible thermosensitive recording layer deteriorates because the matrix resin and the organic low-molecular-weight material becomes compatible with each other by the application of heat thereto, and the condition of the organic low-molecular-weight material dispersed in the matrix resin is changed with time. When the organic low-molecular-weight material has many carbon atoms, the organic low-molecular-weight material is not compatible with the matrix resin, whereby the deterioration of the recording layer can be prevented even though image formation and image erasure are alternately repeated many times. Furthermore, the degree of milky opaque whiteness tends to increase in proportion to the number of carbon atoms for use in the organic low-molecular-weight material.

Suppose that a fatty acid ester and a fatty acid which have the same melting point are independently dispersed in the matrix resin as the low-melting point organic low-molecular-weight materials, thereby obtaining two kinds of recording materials. Although the temperature where the recording layer becomes transparent is the same, the recording layer comprising the fatty acid ester is more advantageous than the recording layer comprising the fatty acid because the whiteness degree of the recording layer in the white opaque state is higher, so that the image contrast is more improved, and the durability of the recording layer is better when the operation of image formation and image erasure is repeatedly carried out for an extended period of time.

By employing such a fatty acid ester and the high-melting point organic low-molecular-weight material in combination in the reversible thermosensitive recording layer, the transparency temperature range can be extended and the erasing properties can be improved. After a long-period of storage, the erasing properties may be changed to some extent, but the image erasure can be carried out. Further, the repeated use durability can be improved.

To be more specific, the fatty acid ester serving as the low-melting point organic low-molecular-weight material can be represented by the following formula (I):

$$R^1—COO—R^2 \quad (I)$$

wherein $R^1$ and $R^2$ are each independently an alkyl group having 10 or more carbon atoms.

It is preferable that the number of carbon atoms of the fatty acid ester be 20 or more, more preferably 25 or more, and further preferably 30 or more.

It is preferable that the melting point of the fatty acid ester be 40° C. or more.

The fatty acid esters represented by the formula (I) may be used alone or in combination.

Specific examples of the fatty acid ester for use in the present invention are octadecyl palmitate, dococyl palmitate, heptyl stearate, octyl stearate, octadecyl stearate, dococyl stearate, octadecyl behenate, and dococyl behenate.

With respect to the dibasic acid esters (b) serving as the low-melting point low-molecular-weight materials, both of a monoester and a diester are acceptable. The dibasic acid esters represented by the following formula are preferably employed in the present invention (II):

$$ROOC—(CH_2)_n—COOR' \quad (II)$$

wherein R and R' are each independently hydrogen atom or an alkyl group having 1 to 30 carbon atoms, both of which may be the same or different except that both represent hydrogen atom at the same time; and n is an integer of 0 to 40.

In the dibasic acid ester represented by the formula (II), it is preferable that the number of carbon atoms of the alkyl group represented by R and R' be in the range of 1 to 22, more preferably in the range of 1 to 30, and further preferably in the range of 2 to 20. It is preferable that the melting point of the dibasic acid ester be 40° C. or more.

Specific examples of the dibasic acid ester are succinate, adipate, sebacate, 1-octadecamethylene dicarboxylate, and 18-octadecamethylene dicarboxylate.

The polyhydric alcohol alkanedioic acid esters (c) serving as the low-melting point organic low-molecular-weight materials are represented by the following formula (III):

$$CH_3(CH_2)_m—_2COO(CH_2)_nOOC(CH_2)_m—_2CH_3 \quad (III)$$

wherein n is an integer of 2 to 40, preferably 3 to 30, and more preferably 4 to 22; and m is an integer of 2 to 40, preferably 3 to 30, and more preferably 4 to 22.

Specific examples of the polyhydric alcohol alkanedioic acid ester (c) are as follows: 1,3-propanediol alkanedioic acid ester, 1,6-hexanediol alkanedioic acid ester, 1,10-decanediol alkanedioic acid ester, and 1,18-octadecanediol alkanedioic acid ester.

The melting point of a polyhydric alcohol alkanedioic acid ester is lower than that of the fatty acid having the same number of carbon atoms as that of the polyhydric alcohol alkanedioic acid ester. In other words, the number of carbon atoms of the polyhydric alcohol alkanedioic acid ester is more than that of the fatty acid having the same melting point as that of the above-mentioned polyhydric alcohol alkanedioic acid ester.

As previously mentioned, it is considered that when the organic low-molecular-weight material becomes compatible with the matrix resin in the reversible thermosensitive recording layer by the application of heat thereto using a thermal head, the durability of the recording layer deteriorates. When the organic low-molecular-weight material has many carbon atoms, the organic low-molecular-weight material is not compatible with the matrix resin, whereby the deterioration of the recording layer can be prevented even though image formation and image erasure are alternately repeated many times. Furthermore, the degree of milky opaque whiteness tends to increase in proportion to the number of carbon atoms for use in the organic low-molecular-weight material. Therefore, when the polyhydric alcohol alkanedioic acid ester is compared with the fatty acid having the same melting point as that of the above-mentioned polyhydric alcohol alkanedioic acid ester, the repeated use durability of the reversible thermosensitive recording material is considered to be improved although the temperature where the recording layer starts to assume the transparent state is the same.

In addition, although the polyhydric alcohol alkanedioic acid ester has a low melting point, it can contribute to the improvement of the repeated use durability of the recording layer to the same extent as a fatty acid having a melting point higher than that of the polyhydric alcohol alkanedioic acid ester can do. Therefore, when the polyhydric alcohol alkanedioic acid ester is used in combination with a high-melting point organic low-molecular-weight material, the polyhydric alcohol alkanedioic acid ester can serve to extend the transparency temperature range, with contributing to the improvement of the whiteness degree of the recording layer and the repeated use durability. Therefore, to erase the image from the recording layer, that is, to make the recording layer transparent, can be achieved by heat application for a short period of time using a thermal head. In addition, since the temperature range for image erasure is extended, the image erasure operation can be carried out without any practical problem although the energy required for the image erasure operation varies with time.

As the previously mentioned high-melting point organic low-molecular-weight material, the following compounds can be employed:

(d) aliphatic saturated dicarboxylic acids, (e) ketones having a higher alkyl group, (f) semicarbazones derived from the above-mentioned ketones, and (g) α-phosphonofatty acids.

The above-mentioned high-melting point organic low-molecular-weight materials may be used alone or in combination.

The high-melting point organic low-molecular-weight materials with a melting point of 100° C. or more will be explained.

Specific examples of the aliphatic saturated dicarboxylic acids (d) having a melting point in the range of about 100 to 135° C. are as follows: succinic acid, glutaric acid, adipic acid, pimelic acid, suberic acid, azelaic acid, sebacic acid, undecanedioic acid, dodecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid, and docosanedioic acid.

The ketones (e) used as the high-melting point organic low-molecular-weight material in the present invention have a ketone group and a higher alkyl group as indispensable constituent groups. The ketones may also include an aromatic ring or heterocyclic ring which may have a substituent.

It is preferable that the entire number of carbon atoms contained in such a ketone (e) be 16 or more, more preferably 21 or more.

The semicarbazones (f) for use in the present invention are derived from the above-mentioned ketones (e).

Specific examples of the ketones (e) and semicarbazones (f) for use in the present invention include 3-octadecanone, 7-eicosanone, 14-heptacosanone, 18-pentatriacontanone, tetradecanophenone, docosanophenone, docosanonaphthophenone, and 2-heneicosanonesemicarbazone.

The α-phosphonofatty acids (g) for use in the present invention can be obtained by the following steps:

A fatty acid is brominated to obtain an α-brominated acid bromide by Hell-Volhard-Zelinskin reaction in accordance with the method by E. V. Kaurer et al. (J. Ak. Oil Chekist's Soc. 41, 205 (1964)). Ethanol is added to the α-brominated acid bromide to obtain an α-bromofatty acid ester. The α-bromofatty acid ester is allowed to react with triethyl phosphite with the application of heat thereto, whereby an α-phosphonofatty acid ester is obtained. The thus obtained α-phosphonofatty acid ester is hydrolyzed in the presence of concentrated hydrochloric acid. The product obtained by this hydrolysis is recrystallized from toluene, whereby the α-phosphonofatty acid (g) for use in the present invention is obtained.

Specific examples of the α-phosphonofatty acid (g) for use in the present invention are as follows: α-phosphonomyristic acid, α-phosphonopalmitic acid, α-phosphonostearic acid, and α-phosphonopelargonic acid.

In the above, the acids other than α-phosphonopelargonic acid have two melting points.

It is preferable that the amount ratio by weight of the low-melting point organic low-molecular-weight material to the high-melting point organic low-molecular-weight material be in the range of (95:5) to (5:95), more preferably in the range of (90:10) to (10:90), and further preferably in the range of (80:20) to (20:80).

In addition to the above-mentioned low-melting point organic low-molecular-weight materials and high-melting point organic low-molecular-weight materials, other organic low-molecular-weight materials may be employed together. For example, there can be employed higher fatty acids such as lauric acid, dodecanoic acid, myristic acid, pentadecanoic acid, palmitic acid, stearic acid, behenic acid, nonadecanoic acid, arachic acid and oleic acid; and ethers and thioethers such as:

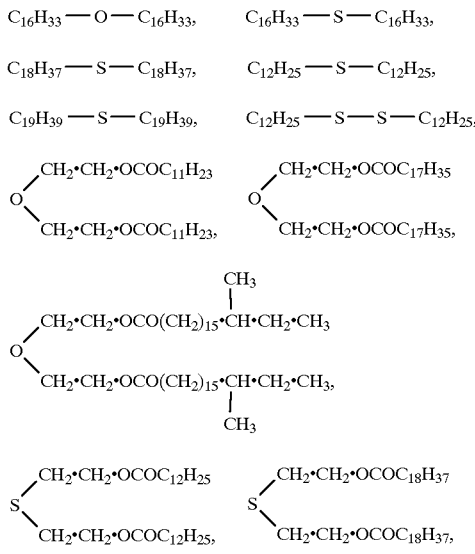

-continued

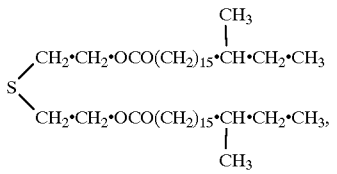

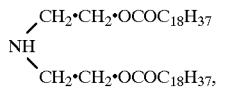

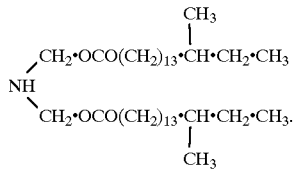

Of those compounds, higher fatty acids, preferably, having 16 or more carbon atoms, more preferably having 16 to 24 carbon atoms, such as palmitic acid, pentadecanoic acid, nonadecanoic acid, arachic acid, stearic acid, behenic acid, and lignoceric acid are preferred in the present invention.

As mentioned previously, in order to expand the transparency temperature range of the reversible thermosensitive recording layer, the above-mentioned organic low-molecular-weight materials may be appropriately used in combination. Alternatively, any of the above-mentioned organic low-molecular-weight materials having different melting points may be used in combination. Examples of the thus obtained reversible thermosensitive recording materials are disclosed in Japanese Laid-Open Patent Applications 63-39378 and 63-130380, and Japanese Patent Applications 63-14754 and 3 -2089. The combination of the organic low-molecular-weight materials with different melting points is not limited to the examples disclosed in the above-mentioned references.

It is preferable that the ratio by weight of the organic low-molecular-weight material to the matrix resin having a cross-linked structure be in the range of about 2:1 to 1:16, and more preferably in the range of 1:2 to 1:8.

When the amount of the resin is in the above-mentioned range, a resin film which can hold the organic low-molecular-weight material can be appropriately formed, and the obtained reversible thermosensitive recording layer can readily assume a white opaque state.

In addition to the above-mentioned components, additives such as a surfactant and a plasticizer may be added to the reversible thermosensitive recording layer in order to facilitate the formation of transparent images.

Examples of the plasticizer include phosphoric ester, fatty acid ester, phthalic acid ester, dibasic acid ester, glycol, polyester-based plasticizers, and epoxy-based plasticizers.

Specific examples of such plasticizers are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethyl butyrate, methyl acetylricinoleate, butyl acetylricinoleate, butylphthalyl butyl glycolate and tributyl acetylcitrate.

Specific examples of the surfactant and other additives are polyhydric alcohol higher fatty acid esters; polyhydric alcohol higher alkyl ethers; lower olefin oxide adducts of polyhydric alcohol higher fatty acid ester, higher alcohol, higher alkyl phenol, higher alkyl amine of higher fatty acid, higher fatty amide, fat and oil, and propylene glycol; acetylene glycol; sodium, calcium, barium and magnesium salts of higher alkylbenzenesulfonic acid, calcium, barium and magnesium salts of aromatic carboxylic acid, higher aliphatic sulfonic acid, aromatic sulfonic acid, sulfonic monoester, phosphoric monoester and phosphoric diester; lower sulfated oil; long-chain polyalkyl acrylate; acrylic oligomer; long-chain polyalkyl methacrylate; copolymer of long-chain alkyl methacrylate and amine-containing monomer; styrene—maleic anhydride copolymer; and olefin—maleic anhydride copolymer.

The previously mentioned reversible thermosensitive recording material of type (2) will now be explained in detail.

The recording material (2) comprises a reversible thermosensitive coloring composition comprising an electron donor type coloring compound and an electron acceptor type compound. The electron acceptor compound is capable of inducing color formation in the electron donor coloring compound upon application of heat thereto.

More specifically, when a mixture of the electron donor coloring compound and the electron acceptor compound is fused under application of heat thereto, an amorphous coloring material is generated therein. Thus, a color development state is formed. The temperature at which the color development state is formed is hereinafter referred to as a color development temperature. Subsequently, when the amorphous coloring material thus obtained in the mixture is heated at a temperature lower than the color development temperature, the color in the coloring material disappears with the crystallization of the electron acceptor compound. Thus, a decolorization state is formed.

This kind of reversible thermosensitive coloring composition shows a surprising behavior of reversible color development and decolorization. The coloring composition instantaneously induces color development by the application of heat thereto, and the thus obtained color development state can be stably maintained at room temperature. The color produced in the coloring composition in the color development state abruptly disappears when the coloring composition is heated at a temperature lower than the color development temperature, and the thus obtained decolorization state can be maintained at room temperature.

The process of color development and decolorization, namely, the process of image formation and erasure, by use of a reversible thermosensitive recording material (2) comprising the above-mentioned thermosensitive coloring composition will be explained with reference to the graph shown in FIG. 3.

Figure 3:
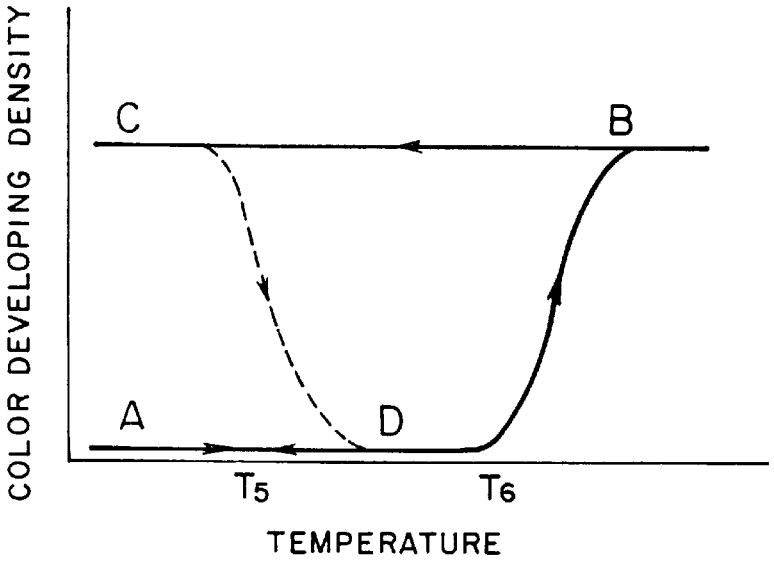
FIG. 3 is a diagram in explanation of the principle of the change in color tone of a reversible thermosensitive recording layer of the reversible thermosensitive recording material according to the present invention, depending upon the temperature thereof.

In FIG. 3, the color developing density of the recording material (2) is plotted as ordinate and the temperature thereof as abscissa. The image formation process by heating operation is indicated by a solid line, and the image erasure process by heating operation, by a dashed line. Density A indicates an original density of the recording material (2) in the complete decolorization state; density B, a density in the complete color development state obtained by heating the coloring composition at temperature of $T_6$ or more; density C, a density in the complete color development state at temperature $T_5$ or less; and density D, a density in the complete decolorization state obtained when the coloring composition in the color development state at $T_5$ or less is heated at a temperature in the range from $T_5$ to $T_6$.

The coloring composition is originally in a decolorization state with the density A at temperature $T_5$ or less. When the coloring composition is heated to temperature $T_6$ or more, for example, by use of a thermal head, in order to carry out the image formation, the coloring composition induces color development and the color developing density reaches the density B. The thus obtained density B of the coloring composition does not decrease even though the coloring composition is cooled to $T_5$ or less as indicated by the solid line, and the density of the obtained image can be maintained as the density C. Thus, the memory characteristics of images are regarded as satisfactory.

To erase the image formed in the recording material (2), the coloring composition for use in the recording material (2) which is in the color development state at $T_5$ or less may be again heated to a temperature in the range of $T_5$ to $T_6$, that is lower than the color development temperature, as indicated by the dashed line. Thus, the image density is decreased from C to D, thereby allowing the coloring composition to assume a decolorization state. Once the coloring composition assumes a decolorization state, the density D of the coloring composition is maintained to the density A even though the temperature of the coloring composition is returned to $T_5$ or less.

In other words, the image forming operation proceeds in accordance with the solid line A-B-C, and the recorded image is maintained in the recording material (2) at the step C. The image erasing operation proceeds in accordance with the dashed line C-D-A, and the decolorization state of the recording material (2) can be maintained at the step A. Such a behavior of image formation and erasure has a reversible characteristic, and these operations can be repeated over a long period of time.

As previously mentioned, the reversible thermosensitive coloring composition for use in the recording material (2) comprises the electron donor coloring compound serving as a coloring agent and the electron acceptor compound serving as a color developer When a mixture of the coloring agent and the color developer is fused by the application of heat thereto, it assumes a color development state; and when the mixture in the color development state is again heated at a temperature lower than the color development temperature, the color produced in the mixture of the coloring agent and the color developer disappears. Both the color development state and the decolorization state can be maintained in a stable condition at room temperature. The color development of the coloring composition takes place when the coloring composition becomes amorphous by heating to the color development temperature. On the other hand, when the coloring composition in the color development state is again heated to a temperature lower than the color development temperature, the decolorization is induced by the crystallization of the color developer in the coloring composition.

For the subsequent image formation in the recording material (2), it is advantageous to heat the recording material (2) to a temperature within the range of $T_5$ to $T_6$ to erase the image. This is because the particles of the coloring agent and the color developer can be returned to the original condition, so that the color development state can be readily formed later.

A conventional coloring composition widely used in a conventional thermosensitive recording sheet comprises a coloring agent, for example, a leuco compound having a lactone ring which is a dye precursor, and a phenolic compound serving as a color developer. This kind of coloring composition assumes a color development state by the application of heat thereto because the lactone ring of the leuco compound is opened when a mixture of the leuco compound and the phenolic compound is fused under application of heat thereto. In such a color development state, the coloring composition assumes an amorphous state in which both the leuco compound and the phenolic compound are soluble in each other. The amorphous state of the coloring composition can be stably maintained at room temperature. However, even though the coloring composition in the amorphous state is again heated, the phenolic compound does not crystallize out of the leuco compound, so that the lactone ring of the leuco compound is not closed, with the result that the color produced in the coloring composition does not disappear.

When compared with the above-mentioned conventional coloring composition, the reversible thermosensitive coloring composition for use in the recording material (2) can similarly assume a color development state when the composition is fused so as to make the composition amorphous, and such a color development state can be stably maintained at room temperature. However, when the reversible thermosensitive coloring composition in a color development state is again heated to a temperature lower than the color development temperature, in other words, the temperature lower than the fusing point of the coloring composition, crystallization of the color developer takes place, so that the color developer cannot be kept compatible with the coloring agent. Thus, the color developer separates from the coloring agent, so that the color developer cannot accept an electron from the coloring agent, and consequently, the coloring agent is decolorized.

Such a peculiar behavior of color development and decolorization of the reversible thermosensitive coloring composition for use in the recording material (2) is affected by the mutual solubility of the coloring agent and the color developer when they are fused under application of heat thereto, the intensity of the actions of the coloring agent and the color developer in the color development state, the solubility of the color developer in the coloring agent, and the crystallizability of the color developer. In principle, any coloring composition comprising a coloring agent and a color developer that can assume an amorphous state when fused under application of heat thereto, and that can crystallize when heated at a temperature lower than the color development temperature is available for the recording material (2) in the present invention. Such a coloring composition shows endothermic change in the course of fusion, and exothermic change in the course of crystallization according to the thermal analysis. Therefore, it is easy to find the coloring composition suitable for the recording material (2) by the thermal analysis.

In addition, the reversible thermosensitive coloring composition for use in the recording material (2) may comprise a third material, for example, a binder resin such as a polymeric material. It has been confirmed that the coloring composition further comprising the polymeric material can show the same behavior of color development and decolorization as previously stated.

As the binder resin for use in the above-mentioned recording material (2), the same matrix resins as employed in the reversible thermosensitive recording layer of the recording material (1) are usable.

The decolorization of the reversible thermosensitive coloring composition results from the crystallization of the color developer out of the coloring agent. With this fact taken into consideration, the selection of the color developer is significant for obtaining the recording material (2) which can show excellent decolorization performance.

In any case, for cross-linking of the matrix resin for use in the reversible thermosensitive recording layer, the matrix resin may be subjected to heat application, ultraviolet light irradiation or electron beam irradiation. In particular, the cross-linking by the electron beam irradiation is most suitable in the present invention.

To be more specific, the following methods are usable for cross-linking of the matrix resin:

(i) the method of employing a crosslinkable resin, (ii) the method of using a cross-linking agent, (iii) the method of applying the ultraviolet light or electron beam to the resin, and (iv) the method of applying the ultraviolet light or electron beam to the resin in the presence of a cross-linking agent.

Examples of the cross-linking agent for use in the present invention include urethane acrylate oligomers, epoxy acrylate oligomers, polyester acrylate oligomers, polyether acrylate oligomers, vinyl oligomers, unsaturated polyester oligomers, monofunctional and polyfunctional acrylate monomers, monofunctional and polyfunctional methacrylate monomers, monofunctional and polyfunctional vinyl ester monomers, monofunctional and polyfunctional styrene derivative monomers, and monofunctional and polyfunctional allyl compound monomers.

Specific examples of the non-functional monomers serving as the cross-linking agents are as follows:

methyl methacrylate (MMA), ethyl methacrylate (EMA), n-butyl methacrylate (BMA), i-butyl methacrylate (IBMA), t-butyl methacrylate (TBMA), 2-ethylhexyl methacrylate (EHMA), lauryl methacrylate (LMA), alkyl methacrylate (SLMA), tridecyl methacrylate (TDMA), stearyl methacrylate (SMA), cyclohexyl methacrylate (CHMA), and benzyl methacrylate (BZMA).

Specific examples of the monofunctional monomers serving as the cross-linking agents are as follows:

methacrylic acid (MMA), 2-hydroxyethyl methacrylate (HEMA), 2-hydroxypropyl methacrylate (HPMA), dimethylaminoethyl methacrylate (DMMA), dimethylaminoethyl methylchloride salt methacrylate (DMCMA), diethylaminoethyl methacrylate (DEMA), glycidyl methacrylate (GMA), tetrahydrofurfuryl methacrylate (THFMA), allyl methacrylate (AMA), ethylene glycol dimethacrylate (EDMA), triethylene glycol dimethacrylate (3EDMA), tetraethylene glycol dimethacrylate (4EDMA), 1,3-butylene glycol dimethacrylate (BDMA), 1,6-hexanediol dimethacrylate (HXMA), trimethylolpropane trimethacrylate (TMPMA), 2-ethoxyethyl methacrylate (ETMA), 2-ethylhexyl acrylate, phenoxyethyl acrylate, 2-ethoxyethyl acrylate, 2-ethoxyethoxyethyl acrylate, 2-hydroxyethyl acrylate, 2-hydroxypropyl acrylate, dicyclopentenyloxy ethyl acrylate, N-vinyl pyrrolidone, and vinyl acetate.

Specific examples of bifunctional monomers serving as the cross-linking agents are as follows:

1,4-butanediol acrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, bisphenol A. EO adduct diacrylate, glycerin methacrylate acrylate, diacrylate with 2-mole adduct of propylene oxide of neopentyl glycol, diethylene glycol diacrylate, polyethylene glycol (400) diacrylate, diacrylate of the ester of hydroxypivalic acid and neopentyl glycol, 2,2-bis (4-acryloxyodiethoxyphenyl)propane, diacrylate of neopentyl glycol adipate represented by the following formula:

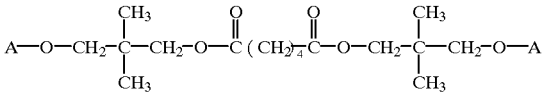

wherein A is $CH_2{=}CH\overset{O}{\overset{\|}{C}}-$ (acryloyl group), diacrylate of Σ-caprolactone adduct of neopentyl glycol hydroxypivalate represented by the following formula:

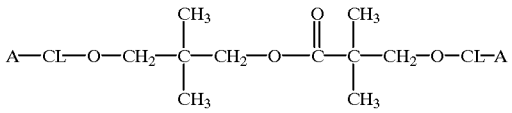

wherein CL is $-O-(CH_2)_5-\overset{O}{\overset{\|}{C}}-$ (ε-caprolactone), diacrylate of Σ-caprolactone adduct of neopentyl glycol hydroxypivalate represented by the following formula:

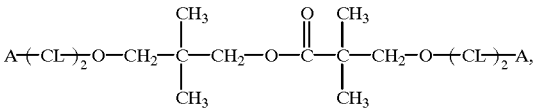

2-(2-hydroxy-1,1-dimethylethyl)-5-hydroxymethyl-5-ethyl-1,3-dioxanediacrylate represented by the following formula:

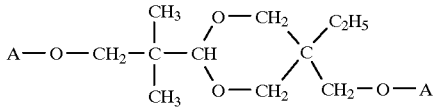

tricyclodecanedimethylol diacrylate represented by the following formula:

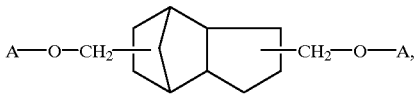

Σ-caprolactone adduct of tricyclodecanedimethylol diacrylate represented by the following formula:

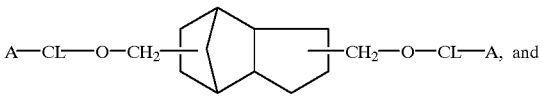

diacrylate of diglycidyl ether of 1,6-hexanediol represented by the following formula:

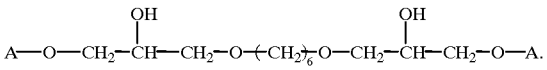

Specific examples of the polyfunctional monomers serving as the cross-linking agents are as follows:

trimethylolpropane triacrylate, pentaerythritol triacrylate, glycerine PO-adduct triacrylate represented by the following formulae

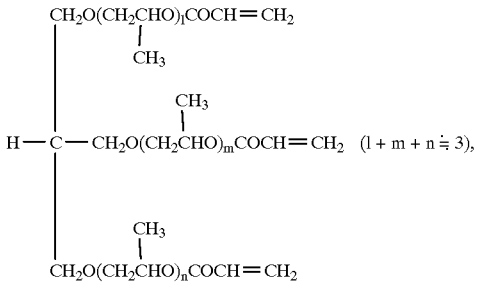

trisacryloyloxyethyl phosphate, pentaerythritol tetraacrylate, triacrylate with 3-mole adduct of propylene oxide of trimethylolpropane, glycerylpropoxy triacrylate, dipentaerythritol•polyacrylate, polyacrylate of caprolactone adduct of dipentaerythritol, propionic acid•dipentaerythritol triacrylate represented by the following formula:

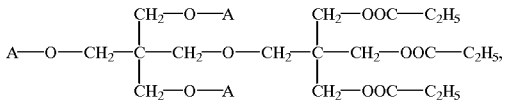

hydroxypivalaldehyde-modified dimethylolpropine triacrylate, tetraacrylate of propionic acid•dipentaerythritol represented by the following formula:

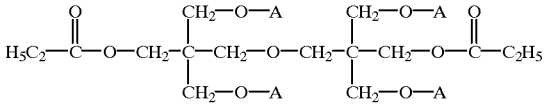

ditrimethylolpropane tetraacrylate, pentaacrylate of dipentaerythritol propionate represented by the following formula:

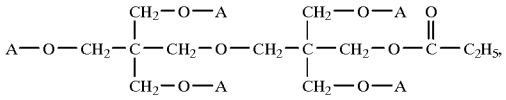

dipentaerythritol hexaacrylate (DPHA) represented by the following formula:

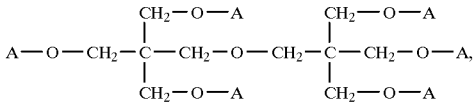

Σ-caprolactone adduct of DPHA represented by the following formula:

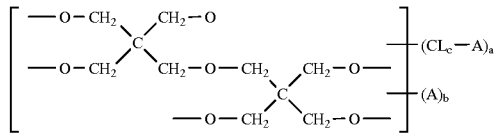

(DPCA-20)

a=2, b=4, c=1

(DPCA-30)

a=3, b=3, c=1

(DPCA-60)

a=6, c=1

(DPCA-120)

a=6, c=2.

One example of the oligomer serving as the cross-linking agent is:

bisphenol A—diepoxyacrylic acid adduct represented by the following formula:

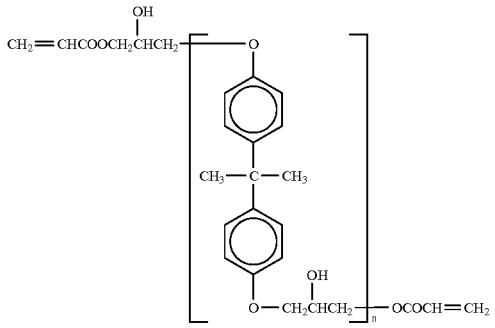

(n ≒ 1.2)

Those cross-linking agents can be used alone or in combination. It is preferable that the amount of the cross-linking agent be in the range of 0.001 to 1.0 part by weight, more preferably in the range of 0.01 to 0.5 parts by weight, to one part by weight of the resin to be subjected to cross-linking. When the amount of the cross-linking agent is within the above-mentioned range, the cross-linking efficiency is sufficient, and at the same time, the milky whiteness degree of the reversible thermosensitive recording layer in a white opaque state does not decrease, so that the decrease of the image contrast can be prevented.

In order to improve the cross-linking efficiency using the cross-linking agent in a minimum amount, the functional monomers are better than non-functional monomers, and in particular, the polyfunctional monomers are preferable to the monofunctional monomers.

When the above cross-linking is performed by ultraviolet light irradiation, the following cross-linking agents, photopolymerization initiators and photopolymerization promoters may be employed.

To be more specific, the cross-linking agents for use in the ultraviolet irradiation can be roughly classified into photopolymerizable prepolymers and photopolymerizable monomers.

As the photopolymerizable monomers, the previously mentioned monofunctional monomers and polyfunctional monomers can be employed.

As the photopolymerizable prepolymers, for instance, polyester acrylate, polyurethane acrylate, epoxy acrylate, polyether acrylate, oligoacrylate, alkyd acrylate, and polyol acrylate can be employed.

These cross-linking agents can be used alone or in combination. It is preferable that the amount of such a cross-linking agent to be added be in the range of 0.001 to 1.0 part by weight, more preferably in the range of 0.01 to 0.5 parts by weight, to one part by weight of the resin to be subjected to cross-linking by the ultraviolet light irradiation. When the amount of the cross-linking agent is within the above-mentioned range, the cross-linking efficiency is sufficient, and at the same time, the milky whiteness degree of the reversible thermosensitive recording layer in a white opaque state does not decrease, so that the decrease of the image contrast can be prevented.

The photopolymerization initiators used in the ultraviolet light irradiation can be roughly classified into radical reaction type initiators and ionic reaction type initiators. The radical reaction type initiators can be further classified into photo-cleavage type initiators and hydrogen-pulling type initiators.

Specific examples of the initiators for use in the present invention are as follows:

1. Benzoin ethers
isobutyl benzoin ether
isopropyl benzoin ether
benzoin ethyl ether
benzoin methyl ether
2. α-acyloxym esters
1-phenyl-1,2-propanedione-2-(o-ethoxycarbonyl)oxym
3. Benzylketals
2,2-dimethoxy-2-phenylacetophenonebenzyl
hydroxycyclohexylphenylketone
4. Acetophenone derivatives
diethoxyacetophenone
2-hydroxy-2-methyl-1-phenylpropane-1-one
5. Ketone-(ketone-amine)
benzophenone
chlorothioxanthone
2-chlorothioxanthone
isopropyl thioxanthone
2-methyl thioxanthone
chlorine-substituted benzophenone Those photopolymerization initiators can be used alone or in combination. It is preferable to employ such an initiator in an amount of 0.005 to 1.0 part by weight, more preferably 0.01 to 0.5 parts by weight, to one part of any of the previously mentioned cross-linking agents.

The photopolymerization promoters have an effect of increasing the hardening rate of the hydrogen-pulling type photopolymerization initiators such as the benzophenone-type and thioxanthone-type initiators. As such photopolymerization promoters, there can be employed aromatic tertiary amine type photopolymerization promoters and aliphatic amine type photopolymerization promotors.

Specific examples of the photopolymerization promoters include isoamyl p-dimethylaminobenzoate and ethyl p-dimetylaminobenzoate.

These photopolymerization promoters can be used alone or in combination. It is preferable to employ such a photopolymerization promotor in an amount of 0.1 to 5 parts by weight, more preferably in an amount of 0.3 to 3 parts by weight, to one part by weight of a photopolymerization initiator.

An ultraviolet light irradiation apparatus for use in the present invention is composed of a light source, a radiation unit, a power source, a cooling unit, and a transportation unit. As the light source, a mercury lamp, a metal halide lamp, a gallium lamp, a mercury xenon lamp, or a flashlamp may be employed. However, any light source can be employed as long as it has a light emitting spectrum corresponding to the ultraviolet absorption wavelength for the previously mentioned photopolymerization initiators and photopolymerization promotors.

As to the conditions for ultraviolet light irradiation, the lamp output and transportation speed may be determined in accordance with the irradiation energy necessary for cross-linking the resin to be crosslinked.

In the present invention, a particularly effective electron beam irradiation method for cross-linking the resin for use in the reversible thermosensitive recording layer will be describe in detail.

Generally, EB (electron beam) irradiation apparatus can be classified into a scan beam EB irradiation apparatus and an area beam EB irradiation apparatus. An appropriate EB irradiation apparatus may be chosen in accordance with the desired irradiation area, exposure and other factors.

The EB radiation conditions can be determined by the following formula in accordance with the necessary exposure of the resin to be crosslinked to electron beam, with the current, radiation width and transportation speed being taken into consideration:

$$D=(\Delta E/\Delta R)\cdot\rho\cdot I/(W\cdot V)$$

wherein D: necessary exposure to electron beam (Mrad),

ΔE/ΔR: average energy loss,

η: efficiency,

I: current (mA),

W: radiation width (cm), and

V: transportation speed (cm/s).

For industrial purpose, the above formula is simplified as D·V=K·I/W, and the apparatus rating is indicated by Mrad·/min.

The current rating is selected in such a manner that about 20 to 30 mA is for an experimental apparatus, about 50 to 100 mA is for a pilot apparatus and about 100 to 500 mA is for an industrial apparatus.

As to the necessary exposure of the resin to electron beam for the cross-linking of the resin, the cross-linking efficiency varies depending on the kind of resin to be crosslinked, the polymerization degree thereof, the kind of cross-linking agent employed, the amount thereof, the kind of plasticizer employed, the amount thereof and other factors, so that the gel percentage of the resin is not always constant for a constant exposure to electron beam. Therefore, a reversible thermosensitive recording layer of a reversible thermosensitive recording material may be fabricated in accordance with the levels for the constituent factors therefor, and the desired gel percentage may be determined. Then, the necessary exposure to electron beam may be determined in accordance with the desired gel percentage.

In the case where high energy is required for the cross-linking of the resin, it is preferable that the radiation of electron beam to the resin be separately performed a plurality of times in order to avoid the deformation or thermal decomposition of the resin or the support for the reversible thermosensitive recording material by the heat generated by the application of electron beam with high energy.

Prior to the cross-linking of the resin by electron beam irradiation, it is preferable to heat the resin for use in the reversible thermosensitive recording layer to a temperature at which at least part of the organic low-molecular-weight material contained in the recording layer be melted. In this case, it is more preferable that the organic low-molecular-weight material be melted in its entirety.

The relationship between the constituent factors for the reversible thermosensitive recording layer and the gel percentage of the resin is as follows:

As the resin for the reversible thermosensitive recording layer, any of the previously mentioned resins can be employed. However, there is the tendency that the gel percentage is increased as the polymerization degree (P) of the resin is increased. Therefore, it is preferable that the polymerization degree (P) be 300 or more, more preferably 600 or more.

As to the kinds of cross-linking agent that can be employed in the present invention and the amount thereof have been previously mentioned. As the plasticizer used in the resin for the cross-linking by the electron beam irradiation, there can be preferably employed fatty acid esters, polyester-based plasticizers, and epoxy-based plasticizers. Of these plasticizers, epoxy-based plasticizers are optimal because the color change of the resin by the EB irradiation can be prevented, and the cross-linking efficiency is satisfactory.

There is the tendency that the gel percentage is increased as the amount of plasticizer is increased. Therefore, it is preferable that such a plasticizer be added in an amount of 0.01 to 1.0 part by weight, more preferably in an amount of 0.05 to 0.5 parts by weight, to one part by weight of the resin.

In addition to the above, the repeated use durability of the reversible thermosensitive recording layer of the recording material can be improved by the following methods:

First, the higher the softening point of the reversible thermosensitive recording layer, the better the repeated use durability of the obtained recording layer.

The softening point of the recording layer is measured using a thermo-mechanical analyzer (TMA) or a dynamic viscoelasticity measuring apparatus after a sample film of the reversible thermosensitive recording layer is prepared in the same manner as in the measurement of the gel percentage. In the case where the reversible thermosensitive recording layer is formed on the support, the softening point of the recording layer may also be measured using the rigid-body pendulum type physical properties testing instrument or the dynamic viscoelasticity measuring apparatus, without peeling the recording layer off the support.

When the softening point of the recording layer hardly varies with time, the change of the transparency temperature range and the width thereof can be minimized.

To improve the repeated use durability of the recording material, a protective layer may be provided on the reversible thermosensitive recording layer as described later. In this case, the durability can be further improved by increasing the interlaminar strength between the recording layer and the protective layer. The interlaminar strength of the layers can be measured in accordance with the method as described in Tappi UM-403.

The durability of the reversible thermosensitive recording layer can also be-determined by the penetration in the TA penetration test. The smaller the penetration, the better the repeated use durability of the recording layer.

Using the same TMA as employed in the measurement of the softening point, the penetration of the recording layer is measured in such a manner that, a probe of which edge portion has a tiny sectional area is placed on the recording layer formed on the support, and the penetration of the loaded probe into the recording layer is measured. When necessary, heat may be applied.

Further, it is considered that the durability of the reversible thermosensitive recording layer can be improved when the amount of cross-linking agent remaining in the recording layer is minimized after cross-linking of the resin by EB irradiation. The less the remaining cross-linking agent, the better the repeated use durability of the recording layer.

The amount of cross-linking agent remaining in the recording layer is measured using an ATR measuring device attached to the Fourier transform infrared spectrophotometer. A sample film of the reversible thermosensitive recording layer is prepared in the same manner as in the measurement of the gel percentage. After the sample film is subjected to cross-linking by the EB irradiation, the intensity of the absorption band due to CH out-of-plane deformation vibration of an acryloyl group, which appears at about 810 $cm^{-1}$, may be measured. The above-mentioned intensity of the absorption band is in proportion to the remaining amount of cross-linking agent. The less the remaining amount of cross-linking agent, the weaker the intensity of the absorption band.

It is preferable that the remaining amount of cross-linking agent be 0.2 parts by weight or less, more preferably 0.1 parts by weight or less, further preferably 0.05 parts by weight, and still further preferably 0.01 parts by weight, to one part by weight of the resin for use in the reversible thermosensitive recording layer.

Furthermore, in the case where there are vacant gaps of which a refractive index is different from the refractive indexes of the matrix resin and the organic low-molecular-weight material at the interfaces between the matrix resin and the particles of the organic low-molecular-weight material and/or within the particles of the organic low-molecular-weight material in the reversible thermosensitive recording layer, the image density of a milky white opaque portion is improved, and accordingly the image contrast is also improved. This effect is significant when the size of such vacant gaps be 1/10 or more the wavelength of the light for detecting the milky white opaque portion.

When the images thus formed in this reversible thermosensitive recording layer of the recording material (1) are used as reflection images, it is preferable to place a light reflection layer behind the reversible thermosensitive recording layer When such a light reflection layer is provided, the image contrast can be increased even when the reversible thermosensitive recording layer is thin. Such a light reflection layer is made by vacuum deposition of Al, Ni, Sn or the like, as disclosed in Japanese Laid-Open Patent Application 64-14079.

As mentioned previously, a protective layer may be provided on the reversible thermosensitive recording layer. Examples of the material for such a protective layer (with a thickness of 0.1 to 10 $\mu$m) are a silicone rubber and a silicone resin as disclosed in Japanese Laid-Open Patent Application 63-221087; a polysiloxane graft polymer as disclosed in Japanese Patent Application 62-152550; and an ultraviolet curing resin and an electron beam curing resin as disclosed in Japanese Patent Application 63-310600.

When a protective layer is formed using any of the above-mentioned materials, a solvent is used for coating the protective layer. It is preferable that the solvent used for this object be such a solvent that the resin and the organic low-molecular-weight material for the reversible thermosensitive recording layer are not soluble or slightly soluble therein.

Specific examples of such a solvent include n-hexane, methyl alcohol, ethyl alcohol, and isopropyl alcohol. In view of the cost, alcohol solvents are preferable.

It is possible to cure the protective layer simultaneously with the cross-linking of the matrix resin in the reversible thermosensitive recording layer. In this case, the reversible thermosensitive recording layer is formed on a support by the previously mentioned method, and a protective layer formation liquid is coated on the recording layer and dried. Thereafter, the coated protective layer and the recording layer may be both cured by EB irradiation using the previously mentioned electron beam irradiation apparatus under the aforementioned conditions, or to ultraviolet light irradiation using the previously mentioned ultraviolet light irradiation apparatus under the aforementioned conditions.

In order to protect the reversible thermosensitive recording layer from the solvent and/or monomer component which is contained in the protective layer formation liquid, an intermediate layer may be interposed between the protective layer and the reversible thermosensitive recording layer, as disclosed in Japanese Laid-Open Patent Application 1-133781. As the material for the intermediate layer, the same materials as those for the matrix resin for the reversible thermosensitive recording layer can be employed. In addition to those materials, the following thermosetting resins and thermoplastic resins can be employed. Specific examples of such resins are polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness in the range of 0.1 to 2 $\mu$m.

In order to make the images formed in the reversible thermosensitive layer clearer and more visible, a colored layer may be interposed between the support and the recording layer.

Such a colored layer can be formed by coating a solution or dispersion of a coloring agent and a binder resin to the surface to be coated therewith, drying the coated solution or dispersion. Alternatively, the colored layer may be formed by applying a colored sheet to the subject surface.

As the coloring agent for use in the colored layer, any dyes and pigments can be employed as long as the transparent and milky white images formed on the recording layer which is situated above the colored layer can be made recognizable as reflection images, so that dyes and pigments with colors such as red, yellow, blue, dark blue, purple, black, brown, grey, orange and green can be employed.

As the binder resin for the colored layer, varieties of thermoplastic resins, thermosetting resins and ultraviolet-curing resins can be employed.

An air layer which constitutes a non-contact portion can be interposed between the support and the reversible thermosensitive recording layer.

When such an air layer is interposed between the support and the recording layer, there is a large difference in refractive index between the recording layer and the air layer because the refractive indexes of the organic polymeric materials for the recording layer are in the range of about 1.4 to 1.6, while the refractive index of the air in the air layer is 1.0.

Therefore, light is reflected at the interface between the surface of the recording layer and the air layer which constitutes the non-contact portion, so that when the recording layer is in the milky white state, the milky white opaqueness is intensified, and therefore the images can be made more easily visible. Therefore it is preferable that such a non-contact portion be employed as a display portion of the reversible thermosensitive recording material.

The non-contact portion contains air therein, so that the non-contact portion serves as a heat insulating layer. Therefore the thermosensitivity of the recording layer is improved.

The non-contact portion also serves as a cushion, so that even when a thermal head is brought into pressure contact with the recording layer, the pressure actually applied to the recording layer is reduced and the deformation of the recording layer, if any, is minimal. Therefore, the particles of the organic low-molecular-weight material are not crushed flat or deformed. Thus, the repeated use durability of the reversible thermosensitive recording layer is improved.

Furthermore, it is also possible to apply an adhesive layer to the back side of the support, that is, the side opposite to the recording layer with respect to the support, in order to use the reversible thermosensitive recording material as a reversible thermosensitive recording adhesive label. Such a reversible thermosensitive recording adhesive label can be applied to a base sheet or plate. Examples of such a base sheet or plate are polyvinyl chloride cards for credit cards, IC cards, ID cards, paper, film, synthetic paper, boarding pass, and commuter's pass. The above-mentioned base sheet or plate are not limited to these sheets or cards.

In the case where the support is, for example, an aluminum-deposited support which has poor adhesiveness to a resin, an adhesive layer may be interposed between the support and the reversible thermosensitive recording layer as disclosed in Japanese Laid-Open Patent Application 3-7377.

To perform the image display in the reversible thermosensitive recording material of the present invention, a variety of image display apparatuses can be employed. For instance, there can be employed an apparatus comprising a heating element such as a thermal head which is used as both of the image formation means and image erasure means by changing the energy applied to the heating element for the image formation operation and the image erasure operation. Alternatively, an image display apparatus may comprise the image formation means such as a thermal head, and the image erasure means, which is any means of a pressure-application contact type, such as a thermal head, hot stamp, heat-application roller or heat-application block, or a non-contact type, such as heated air or infrared rays.

In the above-mentioned reversible thermosensitive recording material (1), the reversible thermosensitive recording layer is not distorted and the organic low-molecular-weight material contained therein is not deformed when a cross-linking structure is formed in the entire recording layer As a result, image formation and image erasure can be always performed in a good condition. The stability of the recording material is maintained for a long period of time. In the reversible thermosensitive recording material (2), the problem that the color deviation occurs in the color development state can be solved by cross-linking the binder resin for use in the recording layer.

Other features of this invention will become apparent in the course of the following description of exemplary embodiments, which are given for illustration of the invention and are not intended to be limiting thereof.

EXAMPLE 1

Preparation of Reversible Thermosensitive Recording Material

[Formation of magnetic recording layer]

The following components were mixed to prepare a coating liquid for a magnetic recording layer:

| | Parts by Weight |
|---|---|
| $\gamma$-$Fe_2O_3$ | 10 |
| Vinyl chloride - vinyl acetate - phosphate copolymer (Trademark: "VAGH", made by UCC Company, Ltd.) | 10 |
| 50% toluene solution of isocyanate (Trademark: "Coronate L", made by Nippon Polyurethane Industry Co., Ltd.) | 2 |
| Methyl ethyl ketone | 40 |
| Toluene | 40 |

The thus obtained coating liquid was coated on a polyester film with a thickness of about 188 $\mu$m serving as a support by a wire bar, and dried under application of heat thereto, so that a magnetic recording layer with a thickness of about 10 $\mu$m was formed on the support.

(Formation of smoothing layer)

The following components were mixed to prepare a coating liquid for a smoothing layer:

| | Parts by Weight |
|---|---|
| 49% butyl acetate solution of acrylate-based ultraviolet-curing resin (Trademark: "Unidic C7-164", made by Dainippon Ink & Chemicals, Incorporated.) | 10 |
| Toluene | 4 |

The thus obtained coating liquid was coated on the above prepared magnetic recording layer by a wire bar, dried under application of heat thereto, and cured by exposing to an ultraviolet lamp of 80 W/cm for 5 seconds, so that a smoothing layer with a thickness of about 1.5 $\mu$m was formed on the magnetic recording layer.

(Formation of light reflection layer)

Al was vacuum-deposited on the above prepared smoothing layer, so that a light reflection layer with a thickness of about 400 Å was formed on the smoothing layer.

(Formation of adhesive layer)

The following components were mixed to prepare a coating liquid for an adhesive layer:

| | Parts by Weight |
|---|---|
| Vinyl chloride - vinyl acetate - phosphate copolymer (Trademark: "Denka Vinyl #1000P", made by Denki Kagaku Kogyo K.K.) | 5 |
| Tetrahydrofuran | 95 |

The thus obtained coating liquid was coated on the above prepared light reflection layer and dried under application of heat thereto, so that an adhesive layer with a thickness of about 0.5 $\mu$m was formed on the light reflection layer.

(Formation of reversible thermosensitive recording layer)

The following components were mixed to prepare a coating liquid for a reversible thermosensitive recording layer:

| | Parts by Weight |
|---|---|
| Octadecyl stearate (Trademark: "M9676", made by Nippon Oils and Fats Co., Ltd.) | 5 |
| Eicosanedioic acid (Trademark: "SL-20-99", made by Okamura Oil Mill Ltd.) | 5 |
| Di-isodecyl phthalate | 3 |
| Vinyl chloride - vinyl propionate copolymer (70:30, with an average polymerization degree of 500) (Product No. "20-1834" on an experimental basis, available from Kaneka Corporation) | 37 |
| Polyfunctional monomer, DPCA-30 (Trademark: "DPCA-30", made by Nippon Kayaku Co., Ltd.) | 6.2 |
| Tetrahydrofuran | 180 |
| Toluene | 60 |
| Epoxidized linseed oil with an epoxy equivalent of 172 g/eq (Trademark: "Adeka Cizer 0-180A" made by Asahi Denka Kogyo K.K.) | 0.6 |

The thus obtained coating liquid for a recording layer was coated on the above prepared adhesive layer, and then dried under application of heat thereto, so that a reversible thermosensitive recording layer with a thickness of about 8 μm was formed on the adhesive layer.

Then, the reversible thermosensitive recording layer was subjected to EB irradiation so that the irradiation dose might be 10 Mrad using a commercially available EB irradiation apparatus "EBC-200-AA2" (Trademark), made by Nissin-High Voltage Co., Ltd. The gel percentage of the resin thus cross-linked by EB irradiation was 98%.

(Formation of protective layer)

The following components were mixed to prepare a coating liquid for a protective layer:

| | Parts by Weight |
|---|---|
| 75% butyl acetate solution of urethane acrylate-based ultraviolet-curing resin (Trademark: "Unidic C7-157", made by Dainippon Ink & Chemicals, Incorporated.) | 10 |
| Isopropyl alcohol | 10 |

After the thus prepared coating liquid was coated on the reversible thermosensitive recording layer using a wire bar and dried, the coated surface was exposed to ultraviolet lamp of 80 W/cm for curing. Thus, a protective layer with a thickness of about 2 μm was provided on the recording layer.

Thus, a reversible thermosensitive recording material No. 1 according to the present invention was obtained.

EXAMPLE 2

The procedure for preparation of the reversible thermosensitive recording material No. 1 in Example 1 was repeated except that the amount of the epoxidized linseed oil for use in the formulation for coating liquid of the reversible thermosensitive recording layer in Example 1 was changed from 0.6 to 2.2 parts by weight.

The gel percentage of the resin thus cross-linked by EB irradiation was 97% in the reversible thermosensitive recording layer.

Thus, a reversible thermosensitive recording material No. 2 according to the present invention was obtained.

EXAMPLE 3

The procedure for preparation of the reversible thermosensitive recording material No. 1 in Example 1 was repeated except that the epoxidized linseed oil with an epoxy equivalent of 172 g/eq (Trademark: "Adeka Cizer 0-180A" made by Asahi Denka Kogyo K.K.) for use in the formulation for coating liquid of the reversible thermosensitive recording layer in Example 1 was replaced by a commercially available epoxidized soybean oil with an epoxy equivalent of 230 g/eq (Trademark: "Adeka Cizer 0-130P" made by Asahi Denka Kogyo K.K.).

The gel percentage of the resin thus cross-linked by EB irradiation was 97% in the reversible thermosensitive recording layer.

Thus, a reversible thermosensitive recording material No. 3 according to the present invention was obtained.

EXAMPLE 4

The procedure for preparation of the reversible thermosensitive recording material No. 3 in Example 3 was repeated except that the amount of the epoxidized soybean oil for use in the formulation for coating liquid of the reversible thermosensitive recording layer in Example 3 was changed from 0.6 to 2.2 parts by weight.

The gel percentage of the resin thus cross-linked by EB irradiation was 96% in the reversible thermosensitive recording layer.

Thus, a reversible thermosensitive recording material No. 4 according to the present invention was obtained.

EXAMPLE 5

The procedure for preparation of the reversible thermosensitive recording material No. 1 in Example 1 was repeated except that the epoxidized linseed oil with an epoxy equivalent of 172 g/eq (Trademark: "Adeka Cizer 0-180A" made by Asahi Denka Kogyo K.K.) for use in the formulation for coating liquid of the reversible thermosensitive recording layer in Example 1 was replaced by a commercially available epoxy resin with an epoxy equivalent of 191 g/eq (Trademark: "Adeka Cizer EP-13" made by Asahi Denka Kogyo K.K.).

The gel percentage of the resin thus cross-linked by EB irradiation was 97% in the reversible thermosensitive recording layer.

Thus, a reversible thermosensitive recording material No. 5 according to the present invention was obtained.

EXAMPLE 6

The procedure for preparation of the reversible thermosensitive recording material No. 5 in Example 5 was repeated except that the amount of the epoxy resin for use in the formulation for coating liquid of the reversible thermosensitive recording layer in Example 5 was changed from 0.6 to 2.2 parts by weight.

The gel percentage of the resin thus cross-linked by EB irradiation was 96% in the reversible thermosensitive recording layer.

Thus, a reversible thermosensitive recording material No. 6 according to the present invention was obtained.

EXAMPLE 7

The procedure for preparation of the reversible thermosensitive recording material No. 1 in Example 1 was repeated except that the epoxidized linseed oil with an epoxy equivalent of 172 g/eq (Trademark: "Adeka Cizer 0-180A" made by Asahi Denka Kogyo K.K.) for use in the formulation for coating liquid of the reversible thermosensitive recording layer in Example 1 was replaced by a commercially available epoxy resin with an epoxy equivalent of 144 g/eq (Trademark: "YH-300" made by Tohto Kasei Co., Ltd.).

The gel percentage of the resin thus cross-linked by EB irradiation was 97% in the reversible thermosensitive recording layer.

Thus, a reversible thermosensitive recording material No. 7 according to the present invention was obtained.

EXAMPLE 8

The procedure for preparation of the reversible thermosensitive recording material No. 7 in Example 7 was repeated except that the amount of the epoxy resin for use in the formulation for coating liquid of the reversible thermosensitive recording layer in Example 7 was changed from 0.6 to 2.2 parts by weight.

The gel percentage of the resin thus cross-linked by EB irradiation was 97% in the reversible thermosensitive recording layer.

Thus, a reversible thermosensitive recording material No. 8 according to the present invention was obtained.

EXAMPLE 9

The procedure for preparation of the reversible thermosensitive recording material No. 1 in Example 1 was repeated except that the epoxidized linseed oil with an epoxy equivalent of 172 g/eq (Trademarks "Adeka Cizer 0-180A" made by Asahi Denka Kogyo K.K.) for use in the formulation for coating liquid of the reversible thermosensitive recording layer in Example 1 was replaced by a commercially available bis(dibutyl tin laurate)oxide (Trademark: "Stann SCAT-1" made by Sankyo Organic Chemicals Co., Ltd.).

The gel percentage of the resin thus cross-linked by EB irradiation was 96% in the reversible thermosensitive recording layer.

Thus, a reversible thermosensitive recording material No. 9 according to the present invention was obtained.

EXAMPLE 10

The procedure for preparation of the reversible thermosensitive recording material No. 9 in Example 9 was repeated except that the amount of the bis(dibutyl tin laurate)oxide for use in the formulation for coating liquid of the reversible thermosensitive recording layer in Example 9 was changed from 0.6 to 2.2 parts by weight.

The gel percentage of the resin thus cross-linked by EB irradiation was 95% in the reversible thermosensitive recording layer.

Thus, a reversible thermosensitive recording material No. 10 according to the present invention was obtained.

Comparative Example 1

The procedure for preparation of the reversible thermosensitive recording material No. 1 in Example 1 was repeated except that the epoxidized linseed oil with an epoxy equivalent of 172 g/eq (Trademark: "Adeka Cizer 0-180A" made by Asahi Denka Kogyo K.K.) for use in the formulation for coating liquid of the reversible thermosensitive recording layer in Example 1 was omitted.

The gel percentage of the resin thus cross-linked by EB irradiation was 98% in the reversible thermosensitive recording layer.

Thus, a comparative reversible thermosensitive recording material No. 1 was obtained.

Comparative Example 2

The procedure for preparation of the reversible thermosensitive recording material No. 1 in Example 1 was repeated except that the epoxidized linseed oil with an epoxy equivalent of 172 g/eq (Trademark: "Adeka Cizer 0-180A" made by Asahi Denka Kogyo K.K.), and the polyfunctional monomer serving as the cross-linking agent, DPCA-30 (Trademark: "DPCA-30", made by Nippon Kayaku Co., Ltd.) for use in the formulation for coating liquid of the reversible thermosensitive recording layer in Example 1 were omitted, and that the coated surface of the reversible thermosensitive recording layer was not subjected to EB irradiation.

The gel percentage of the resin for use in the reversible thermosensitive recording layer was 0%.

Thus, a comparative reversible thermosensitive recording material No. 2 was obtained.

Comparative Example 3

The procedure for preparation of the reversible thermosensitive recording material No. 1 in Example 1 was repeated except that the epoxidized linseed oil with an epoxy equivalent of 172 g/eq (Trademark: "Adeka Cizer 0-180A" made by Asahi Denka Kogyo K.K.) for use in the formulation for coating liquid of the reversible thermosensitive recording layer in Example 1 was replaced by a commercially available epoxy resin with an epoxy equivalent of 954 g/eq (Trademark: "YD-014" made by Tohto Kasei Co., Ltd.).

The gel percentage of the resin thus cross-linked by EB irradiation was 97% in the reversible thermosensitive recording layer.

Thus, a comparative reversible thermosensitive recording material No. 3 was obtained.

Comparative Example 4

The procedure for preparation of the comparative reversible thermosensitive recording material No. 3 in Comparative Example 3 was repeated except that the amount of the epoxy resin for use in the formulation for coating liquid of the reversible thermosensitive recording layer in Comparative Example 3 was changed from 0.6 to 2.2 parts by weight.

The gel percentage of the resin thus cross-linked by EB irradiation was 96% in the reversible thermosensitive recording layer.

Thus, a comparative reversible thermosensitive recording material No. 4 was obtained.

Comparative Example 5

On the same polyester film with a thickness of about 188 μm as employed in Example 1, the magnetic recording layer, smoothing layer, light reflection layer, and adhesive layer were successively overlaid in the same manner as in Example 1.

(Formation of reversible thermosensitive recording layer)

The following components were mixed to prepare a coating liquid for a reversible thermosensitive recording layer:

| | Parts by Weight |
|---|---|
| Octadecyl stearate (Trademark: "M9676", made by Nippon Oils and Fats Co., Ltd.) | 5 |
| Eicosanedioic acid (Trademark: "SL-20-99", made by Okamura Oil Mill Ltd.) | 5 |
| Vinyl chloride - vinyl acetate - vinyl alcohol copolymer (Trademark: "S-Lec A", made by Sekisui Chemical Co., Ltd.) | 30 |
| Isocyanate (Curing agent, Trademark: "Duranate 24A-100", made by Asahi Chemical Industry Co., Ltd.) | 3 |
| Triethylenediamine (Curing promotor) | 0.3 |
| Toluene | 30 |
| Tetrahydrofuran | 120 |

The thus obtained coating liquid for a recording layer was coated on the above prepared adhesive layer, and then dried and cured at 90° C. for 5 minutes by the application of heat thereto, so that a reversible thermosensitive recording layer with a thickness of about 8 μm was formed on the adhesive layer.

The protective layer was provided on the above prepared recording layer in the same manner as in Example 1.

Thus, a comparative reversible thermosensitive recording material No. 5 was obtained.

Using the reversible thermosensitive recording materials of the present invention No. 1 to No. 10 and comparative reversible thermosensitive recording materials No. 1 to No. 5, the following properties were evaluated in the following manner:

(1) Thermal pressure level difference and thermal pressure level difference change ratio of reversible thermosensitive recording layer:

Using the above-mentioned thermal pressure application apparatus, a pressure of 2.5 kg/cm$^2$ was applied to the reversible thermosensitive recording layer of each recording material at 130° C. for 10 seconds. Then, the average thermal pressure level difference ($D_m$) was read using the above-mentioned two-dimensional roughness analyzer "Surfcoder AY-41", recorder "RA-60E", and "Surfcoder SE30K", which are trademarks of Kosaka Laboratory Co., Ltd. The average thermal pressure level difference ($D_m$) was regarded as the initial thermal pressure level difference ($D_I$).

Thereafter, the other sample of the reversible thermosensitive recording layer, which had been prepared simultaneously with the preparation of the sample subjected to the measurement of the initial thermal pressure level difference, was placed in a temperature-controlled bath of 50° C. for 24 hours, and then cooled to room temperature.

Then, the thermal pressure level difference of the recording layer was measured in the same manner as mentioned above to obtain the thermal pressure level difference changed with time ($D_D$). Thus, the thermal pressure level difference change ratio ($D_C$) of the reversible thermosensitive recording layer was calculated from the above obtained initial thermal pressure level difference ($D_I$) and the thermal pressure level difference changed with time ($D_D$).

The results are shown in Table 1.

(2) Corroded area ratio of light reflection layer:

Using each sample of the reversible thermosensitive recording material, the initial corroded area ratio ($S_{PI}$) of the light reflection layer was measured for reference by the above-mentioned method.

The above-mentioned sample was allowed to stand in a thermo-hygrostat of 40° C. and 95% RH for 96 hours. After storage of the recording material under such circumstances, the corroded area ratio ($S_P$) of the light reflection layer was obtained in the same manner. The results are shown in Table 2.

Further, the reflection density of the sample in a transparent state was also measured using a McBeth reflection-type densitometer RD-914 when the initial corroded area ratio ($S_{PI}$) of the light reflection layer was measured. After measuring the above-mentioned reflection density, the recording material was heated in a temperature-controlled bath of 130° C. for one minute and cooled to room temperature so as to make the recording material white opaque. The reflection density of the white opaque recording material was measured using the same densitometer as mentioned above. Thus, the contrast was calculated by subtracting the value of the reflection density of the white opaque recording material from that of the transparent recording material.

The above-mentioned reflection densities of the recording material both in the transparent state and the white opaque state were also measured when the corroded area ratio ($S_P$) was obtained. Then, the contrast was similarly obtained.

The results are shown in Table 2.

(3) Transparency temperature range and width thereof:

Immediately after the preparation of the above-mentioned reversible thermosensitive recording materials, any of them assumed a transparent state. Each of the recording materials was heated in a temperature-controlled bath of 130° C. for one minute, and thereafter cooled to room temperature. Thus, each recording material assumed a white opaque state.

Then, each recording material in a white opaque state was heated at 50° C. for one minute and cooled to room temperature, and the reflection density of the recording material was measured using a McBeth reflection-type densitometer RD-914. The above-mentioned heating and cooling process was repeated in such a manner that the temperature of the recording material was stepwise increased by 1° C. within the range of 50° to 130° C. at the heating step. Each time the heating and cooling process was terminated, the reflection density of the recording material was measured.

The transparency temperature of the recording material was regarded as a temperature to which the recording material was heated at the heating step and cooled to room temperature at the cooling step, with the result that the reflection density exceeded 0.8.

The thus obtained transparency temperature range and the width thereof are shown in Table 3.

Furthermore, immediately after the preparation of each recording material, it was allowed to stand in a temperature-controlled bath of 50° C. for 24 hours, and then, the recording material was cooled to room temperature. The thus obtained recording material was subjected to the measurement of the transparency temperature range and the width thereof in the same manner as mentioned above. The results are also shown in Table 3.

(4) Repeated use durability

Using a commercially available thermal printing test apparatus equipped with a thermal head (Trademark "KBE-40-8MGK1" made by Kyocera Corp.), white opaque images were formed on a transparent background under the conditions that the pulse width was 2.0 msec and the applied voltage was 11.5 V. Thereafter, the white opaque images were erased from the recording material by changing the applied voltage to 8.5 V. Such a cycle of image formation and image erasure was repeated 300 times under the same conditions as mentioned above.

In this durability test, the reflection densities of a white opaque image portion obtained at the image formation step and a transparent portion obtained at the image erasure step were measured using a McBeth reflection-type densitometer RD-914 after the completion of the first cycle and the 300th cycle.

Furthermore, after repeating the image forming and erasing cycles, the color change (to red) of an opaque image portion was visually evaluated on a scale from 1 to 5. According to the above-mentioned scale, no color change was visually observed at the rank 5, and the color change to red was considerable at the rank 1.

The results are shown in Table 4.

TABLE 1

| | Thermal Pressure Level Difference and Change Ratio thereof | | |
|---|---|---|---|
| | Initial thermal pressure level difference ($D_I$) | Thermal pressure level difference changed with time ($D_D$) | Thermal pressure level difference change ratio ($D_C$) |
| Ex. 1 | 17% | 15% | 11.8% |
| Ex. 2 | 19% | 17% | 10.5% |
| Ex. 3 | 18% | 15% | 16.7% |
| Ex. 4 | 20% | 16% | 20.0% |
| Ex. 5 | 16% | 14% | 12.5% |
| Ex. 6 | 17% | 14% | 17.6% |
| Ex. 7 | 18% | 15% | 16.7% |
| Ex. 8 | 17% | 16% | 5.9% |
| Ex. 9 | 18% | 15% | 16.7% |
| Ex. 10 | 18% | 16% | 11.1% |
| Comp. Ex. 1 | 16% | 14% | 12.5% |
| Comp. Ex. 2 | 95% | 98% | 3.2% |
| Comp. Ex. 3 | 17% | 15% | 11.8% |
| Comp. Ex. 4 | 18% | 15% | 16.7% |
| Comp. Ex. 5 | 31% | 6% | 80.6% |

TABLE 2

| | Corroded Area Ratio of Light | | Reflection Density | | |
|---|---|---|---|---|---|
| | Reflection Layer | | Contrast | | |
| | Initial corroded area ratio ($S_{PI}$) | Corroded area ratio after storage (40° C., 95% RH)($S_{PD}$) | Initial contrast | after storage (40° C., 95% RH) | Difference of contrast |
| Ex. 1 | 0.09% | 0.56% | 0.82 | 0.78 | 0.04 |
| Ex. 2 | 0.04% | 0.44% | 0.80 | 0.78 | 0.02 |
| Ex. 3 | 0.12% | 0.62% | 0.78 | 0.74 | 0.04 |
| Ex. 4 | 0.08% | 0.57% | 0.81 | 0.78 | 0.03 |
| Ex. 5 | 0.10% | 0.58% | 0.88 | 0.84 | 0.04 |
| Ex. 6 | 0.06% | 0.48% | 0.81 | 0.78 | 0.03 |
| Ex. 7 | 0.08% | 0.53% | 0.76 | 0.73 | 0.03 |
| Ex. 8 | 0.04% | 0.44% | 0.77 | 0.74 | 0.03 |
| Ex. 9 | 0.12% | 0.76% | 0.89 | 0.81 | 0.08 |
| Ex. 10 | 0.09% | 0.65% | 0.90 | 0.84 | 0.06 |
| Comp. Ex. 1 | 4.72% | 6.34% | 0.57 | 0.39 | 0.18 |
| Comp. Ex. 2 | 0.02% | 0.11% | 0.66 | 0.65 | 0.01 |
| Comp. Ex. 3 | 0.26% | 4.42% | 0.71 | 0.59 | 0.12 |
| Comp. Ex. 4 | 0.21% | 3.96% | 0.74 | 0.63 | 0.11 |
| Comp. Ex. 5 | 0.04% | 0.09% | 0.62 | 0.61 | 0.01 |

TABLE 3

| | Initial Stage | | After Storage at 50° C. for 24 Hours | |
|---|---|---|---|---|
| | Transparency temp. range (° C.) | Width of transparency temp. range (° C.) | Transparency temp. range (° C.) | Width of transparency temp. range (° C.) |
| Ex. 1 | 65–125 | 60 | 66–124 | 58 |
| Ex. 2 | 64–124 | 60 | 65–124 | 59 |
| Ex. 3 | 65–126 | 61 | 66–125 | 59 |
| Ex. 4 | 64–124 | 60 | 65–126 | 61 |

TABLE 3-continued

| | Initial Stage | | After Storage at 50° C. for 24 Hours | |
|---|---|---|---|---|
| | Transparency temp. range (° C.) | Width of transparency temp. range (° C.) | Transparency temp. range (° C.) | Width of transparency temp. range (° C.) |
| Ex. 5 | 65–125 | 60 | 66–125 | 59 |
| Ex. 6 | 65–125 | 60 | 66–125 | 59 |
| Ex. 7 | 65–125 | 60 | 66–125 | 59 |
| Ex. 8 | 65–125 | 60 | 65–124 | 59 |
| Ex. 9 | 66–125 | 59 | 67–125 | 58 |
| Ex. 10 | 67–125 | 58 | 68–124 | 56 |
| Comp. Ex. 1 | 67–125 | 58 | 68–126 | 58 |
| Comp. Ex. 2 | 63–123 | 60 | 65–124 | 59 |
| Comp. Ex. 3 | 67–123 | 56 | 68–123 | 55 |
| Comp. Ex. 4 | 68–124 | 56 | 68–125 | 57 |
| Comp. Ex. 5 | 58–117 | 59 | 81–117 | 36 |

TABLE 4

| | Repeated Use Durability | | | | Color |
|---|---|---|---|---|---|
| | First cycle | | 300th cycle | | Change in |
| | Density of milky white image | Density of transparent portion after image erasure | Density of milky white image | Density of transparent portion after image erasure | Opaque Image after 300th Cycle |
| Ex. 1 | 0.44 | 1.26 | 0.48 | 1.35 | 5 |
| Ex. 2 | 0.53 | 1.33 | 0.56 | 1.43 | 5 |
| Ex. 3 | 0.52 | 1.30 | 0.53 | 1.38 | 5 |
| Ex. 4 | 0.49 | 1.30 | 0.53 | 1.41 | 5 |
| Ex. 5 | 0.39 | 1.27 | 0.45 | 1.39 | 5 |
| Ex. 6 | 0.52 | 1.33 | 0.57 | 1.46 | 5 |
| Ex. 7 | 0.44 | 1.20 | 0.50 | 1.33 | 5 |
| Ex. 8 | 0.51 | 1.28 | 0.54 | 1.41 | 5 |
| Ex. 9 | 0.39 | 1.28 | 0.43 | 1.32 | 5 |
| Ex. 10 | 0.36 | 1.26 | 0.40 | 1.31 | 5 |
| Comp. Ex. 1 | 0.47 | 1.20 | 0.50 | 1.32 | 2 |
| Comp. Ex. 2 | 0.44 | 1.10 | 0.95 | 1.55 | 4 |
| Comp. Ex. 3 | 0.51 | 1.22 | 0.57 | 1.33 | 3 |
| Comp. Ex. 4 | 0.43 | 1.17 | 0.49 | 1.34 | 3 |
| Comp. Ex. 5 | 0.54 | 1.17 | 0.56 | 1.21 | 5 |

As can be seen from the results shown in Tables 1 to 4, the light reflection layer does not corrode even though the reversible thermosensitive recording material of the present invention is allowed to stand under the circumstances of high humidity for a long period of time. Therefore, the decrease of image contrast due to the corrosion of the light reflection layer can be prevented.

The durability of the recording material is also excellent even when image formation and image erasure are repeatedly carried out using a thermal head. In addition, the erasing properties are satisfactory, and the color change is not observed in an opaque image portion even thought image formation and image erasure are repeated many times.

Further, the transparency temperature range is stable while the recording material is repeatedly used.

Japanese Patent Application No. 8-146602 filed on May 16, 1996 is hereby incorporated by reference.

What is claimed is:

1. A reversible thermosensitive recording material comprising a support, a metal-deposited light reflection layer formed thereon, and a reversible thermosensitive recording layer formed on said metal-deposited light reflection layer;

said reversible thermosensitive recording layer comprising either a composition comprising a matrix resin and particles of an organic low molecular weight material or a composition comprising an electron donor compound and an electron acceptor compound and having such transparency or color tone that is reversibly changeable depending upon the temperature thereof, and having a thermal pressure level difference of 40% or less, and a thermal pressure level difference change ratio of 70% or less, and said metal-deposited light reflection layer having a corroded area ratio of at most 2% after allowed to stand at 40° C. and 95% RH for 96 hours.

2. The reversible thermosensitive recording material as claimed in claim 1, wherein said reversible thermosensitive recording layer comprising:

a matrix resin comprising a polymeric resin, finely-divided particles of an organic low-molecular weight material dispersed in said matrix resin, and at least one stabilizer selected from the group consisting of a bis(alkyl tin fatty acid monocarboxylic acid salt) oxide and an epoxy compound with an epoxy equivalent of less than 600 g/eq.

3. The reversible thermosensitive recording material as claimed in claim 2, wherein said polymeric resin comprises a vinyl chloride resin.

4. The reversible thermosensitive recording material as claimed in claim 2, wherein said stabilizer is in an amount of 0.01 to 30 parts by weight to 100 parts by weight of said polymeric resin.

5. The reversible thermosensitive recording material as claimed in claim 2, wherein said polymeric resin is a cross-linked resin prepared by cross-linking.

6. The reversible thermosensitive recording material as claimed in claim 5, wherein said cross-linked resin has a gel percentage of 30% or more.

7. The reversible thermosensitive recording material as claimed in claim 5, wherein said cross-linking is performed using a cross-linking agent.

8. The reversible thermosensitive recording material as claimed in claim 5, wherein said cross-linking is performed by electron beam irradiation.

9. The reversible thermosensitive recording material as claimed in claim 5, wherein said cross-linking is performed by ultraviolet light irradiation.

10. The reversible thermosensitive recording material as claimed in claim 5, wherein said cross-linking is performed by heat application.

11. A recording material according to claim 1, wherein the electron donor and electron acceptor are mutually soluble in one another and assume an amorphous state when fused under the influence of heat.

12. A recording material according to claim 11, wherein the composition comprising an electron donor and electron acceptor also contains a polymeric binder.

13. A recording material according to claim 12, wherein the polymeric binder is cross-linked.

14. A recording material according to claim 13, wherein the cross-linking is effected by heating, UV irradiation or electron beam irradiation.

* * * * *